US011011891B2

(12) United States Patent
Hayashi

(10) Patent No.: US 11,011,891 B2
(45) Date of Patent: May 18, 2021

(54) SPARK PLUG AND IGNITION DEVICE OF INTERNAL COMBUSTION ENGINE

(71) Applicant: DENSO CORPORATION, Kariya (JP)

(72) Inventor: Kosuke Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/431,854

(22) Filed: Jun. 5, 2019

(65) Prior Publication Data

US 2019/0379181 A1 Dec. 12, 2019

(30) Foreign Application Priority Data

Jun. 6, 2018 (JP) ..... JP2018-109029

(51) Int. Cl.

| | |
|---|---|
| ***H01T 13/08*** | (2006.01) |
| ***F02F 1/24*** | (2006.01) |
| ***H01T 13/10*** | (2006.01) |
| ***H01T 13/16*** | (2006.01) |
| *H01T 13/20* | (2006.01) |

(52) U.S. Cl.

CPC ..... *H01T 13/08* (2013.01); *F02F 1/242* (2013.01); *H01T 13/10* (2013.01); *H01T 13/16* (2013.01); *H01T 13/20* (2013.01)

(58) Field of Classification Search

CPC ..... H01T 13/08

See application file for complete search history.

(56) References Cited

U.S. PATENT DOCUMENTS

| | | | | | |
|---|---|---|---|---|---|
| 2,625,921 | A * | 1/1953 | Van Ry | H01T 13/16 | 123/169 V |
| 2,777,431 | A * | 1/1957 | Meurer | F02M 53/046 | 123/470 |
| 2,913,608 | A * | 11/1959 | Fisher | H01T 13/38 | 313/11.5 |
| 3,016,411 | A * | 1/1962 | Fisher | H01T 13/08 | 123/169 C |
| 3,750,392 | A * | 8/1973 | Zoll | F02C 7/266 | 60/39.827 |
| 4,831,995 | A * | 5/1989 | Biton | F02P 13/00 | 123/635 |
| 5,091,672 | A * | 2/1992 | Below | H01T 13/32 | 123/169 R |

(Continued)

FOREIGN PATENT DOCUMENTS

JP 2003-028039 1/2003

*Primary Examiner* — Kevin R Steckbauer

(74) *Attorney, Agent, or Firm* — Nixon & Vanderhye PC

(57) ABSTRACT

A spark plug has a housing of a cylindrical shape, an insulator of a cylindrical shape fitted into the inside of the housing, a center electrode and a ground electrode. No male screw part is formed on an outer peripheral surface of the housing. A housing support surface is formed on an inner peripheral surface of the housing. An outer peripheral surface of the insulator has an insulator support surface which is supported by the housing support surface in an axial direction of the spark plug. The housing has a pressure fitting part to be presses to a cylinder head of an internal combustion engine. A part of the pressure fitting part and a part of at least one of the housing support surface and the insulator support surface are arranged to be overlapped with each other in a radial direction of the spark plug.

10 Claims, 15 Drawing Sheets

(56) References Cited

U.S. PATENT DOCUMENTS 5,535,726 A * 7/1996 Wilmot ..... F02P 13/00 123/169 PA
6,617,769 B2 * 9/2003 Suzuki ..... H01T 13/34 123/169 R
6,655,334 B2 * 12/2003 Inagaki ..... F02F 1/242 123/169 PA
6,703,770 B2 * 3/2004 Suzuki ..... H01T 13/08 123/169 EB
6,756,722 B2 * 6/2004 Hiramatsu ..... G01L 23/22 313/118
6,880,540 B2 * 4/2005 Fuma ..... F02P 3/02 123/169 PA
8,365,694 B2 * 2/2013 Suzuki ..... H01T 13/08 123/169 R
8,365,710 B2 * 2/2013 Lykowski ..... F02B 19/12 123/647
8,544,450 B2 * 10/2013 Megel ..... F02F 1/242 123/470
10,320,156 B2 * 6/2019 Niessner ..... H01T 13/20
2002/0000765 A1 * 1/2002 Suzuki ..... H01T 13/34 313/141
2002/0149308 A1 * 10/2002 Suzuki ..... H01T 13/08 313/141
2002/0157629 A1 * 10/2002 Inagaki ..... F02F 1/242 123/169 PA
2002/0195917 A1 * 12/2002 Hiramatsu ..... G01L 23/22 313/144
2004/0173194 A1 * 9/2004 Fuma ..... F02P 3/02 123/634
2010/0083942 A1 * 4/2010 Lykowski ..... H01T 13/08 123/647
2010/0117506 A1 * 5/2010 Suzuki ..... H01T 13/08 313/141
2011/0044783 A1 * 2/2011 Leyva ..... F16B 37/122 411/37
2011/0083622 A1 * 4/2011 Megel ..... F02F 1/242 123/41.72
2018/0054043 A1 * 2/2018 Niessner ..... H01T 21/02

* cited by examiner

SPARK PLUG AND IGNITION DEVICE OF INTERNAL COMBUSTION ENGINE

CROSS-REFERENCE TO RELATED APPLICATION

This application is related to and claims priority from Japanese Patent Application No. 2018-109029 filed on Jun. 6, 2018, the contents of which are hereby incorporated by reference.

TECHNICAL FIELD

The present disclosure relates to spark plugs to be used in internal combustion engines and related to ignition devices of internal combustion engines.

BACKGROUND

There have been used spark plugs for igniting a fuel mixture gas in a combustion chamber of internal combustion engines mounted on motor vehicles. Such a spark plug has a spark plug housing of a cylindrical shape, an insulator, a center electrode and a ground electrode. The insulator is supported in the inside of the spark plug housing. The center electrode is supported in the inside of the insulator. The ground electrode is arranged at a front end part of the spark plug. The center electrode and the ground electrode are arranged facing with each other along an axial direction of the spark plug so as to form a discharge gap. The spark plug having the structure previously described is mounted on a cylinder head of an internal combustion engine so that a front end part of the spark plug faces an inside of a combustion chamber of the internal combustion engine. That is, the front end part of the spark plug fixed to the cylinder head is exposed to the combustion chamber of the internal combustion engine. A spark discharge is generated at the discharge gap formed between the center electrode and the ground electrode of the spark plug to ignite a fuel mixture gas in the combustion chamber.

SUMMARY

The present disclosure provides a spark plug of an internal combustion engine. The spark plug has a spark plug housing, an insulator, a center electrode and a ground electrode. No male screw part is formed on an outer peripheral surface of the spark plug housing. A housing support surface is formed on an inner peripheral surface of the spark plug housing. An outer peripheral surface of the insulator has an insulator support surface which is supported by the housing support surface in an axial direction of the spark plug. The spark plug housing has a pressure fitting part which is pressed to a cylinder head of the internal combustion engine. A part of the pressure fitting part and a part of at least one of the housing support surface and the insulator support surface are arranged to be overlapped with each other in a radial direction of the spark plug.

In the structure of the spark plug according to the present disclosure, the insulator support surface is formed on the outer peripheral surface of the insulator. The insulator support surface is supported in the axial direction by the housing support surface formed on the inner peripheral surface of the spark plug housing. This improved structure makes it possible to conduct, with high efficiency, thermal energy from the center electrode and the insulator, supported by the spark plug housing, to the spark plug housing through the insulator support surface and the housing support surface. Further, the spark plug housing has the pressure fitting part to be pressed and fitted into the cylinder head of the internal combustion engine. Thermal energy conducted from the housing support surface to the spark plug housing is further conducted to the pressure fitting part in the spark plug housing and finally conducted, i.e. discharged to the cylinder head through the pressure fitting part.

Further, a part of the pressure fitting part and a part of at least one of the housing support surface and the insulator support surface are arranged to be overlapped with each other in the radial direction of the spark plug and the ignition device. This improved structure makes it possible to reduce a distance to the pressure fitting part of the spark plug housing from a thermally conductive part. The thermally conductive part is formed from the insulator support surface to the housing support surface. This structure reduces the thermal energy conductive distance from the thermally conductive part to the pressure fitting part of the spark plug housing. Accordingly, this improved structure of the present disclosure makes it possible to easily and effectively discharge thermal energy from the insulator and the center electrode, etc. in the spark plug housing to the cylinder head of the internal combustion engine.

As previously described, the present disclosure provides the spark plug with no male screw part and the ignition device using the spark plug having superior thermal discharging capability of discharging thermal energy from the spark plug to the cylinder head of the internal combustion engine. In particular, no male screw is formed on an outer peripheral surface of the spark plug housing.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
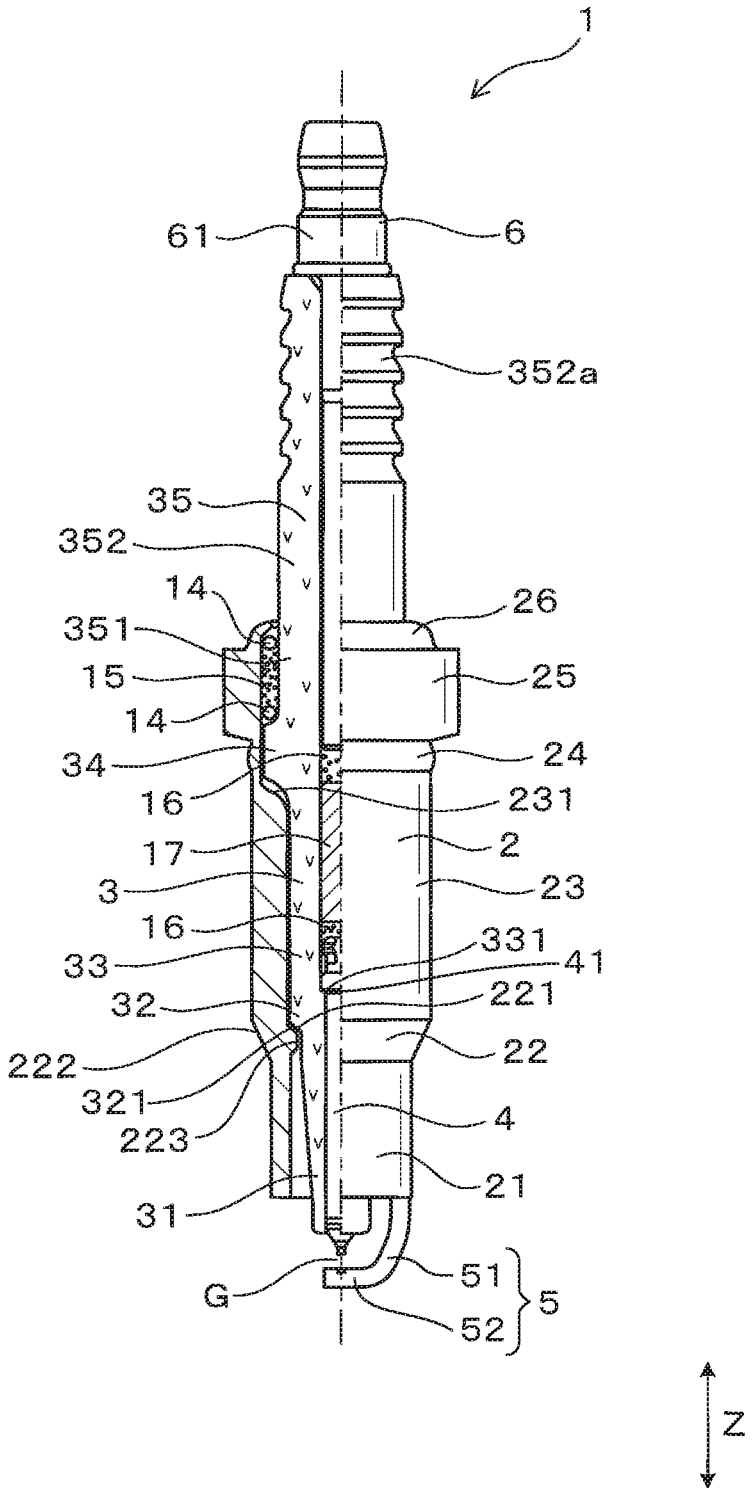
FIG. 1 is a front view showing a partial cross section of the spark plug according to a first exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

First Exemplary Embodiment

A description will be given of a spark plug and an ignition device to be used for internal combustion engines with reference to FIG. 1, FIG. 2 and FIG. 3.

FIG. 1 is a front view showing a partial cross section of the spark plug 1 according to the first exemplary embodiment of the present disclosure. FIG. 2 is a front view showing a partial cross section of the ignition device 10 using the spark plug 1 shown in FIG. 1 according to the first exemplary embodiment of the present disclosure. FIG. 3 is an enlarged view showing a part around a pressure fitting part 222 of a spark plug housing 2, and an insulator support surface 321 in the ignition device 10 shown in FIG. 2. A description will now be given of the spark plug according to the first exemplary embodiment.

As shown in FIG. 1, the spark plug 1 according to the first exemplary embodiment has the spark plug housing 2, an insulator 3, a center electrode 4 and a ground electrode 5. No male screw part is formed on an outer peripheral surface of the spark plug housing 2. The spark plug housing 2 has a cylindrical shape. The insulator 3 is arranged in and supported by the inside of the spark plug housing 2. The insulator 3 has a cylindrical shape. The center electrode 4 is arranged in and supported by the inside of the insulator 3. The ground electrode 5 is joined to the spark plug housing 2. The center electrode 4 and the ground electrode are arranged facing with each other to form a discharge gap G.

Figure 2:
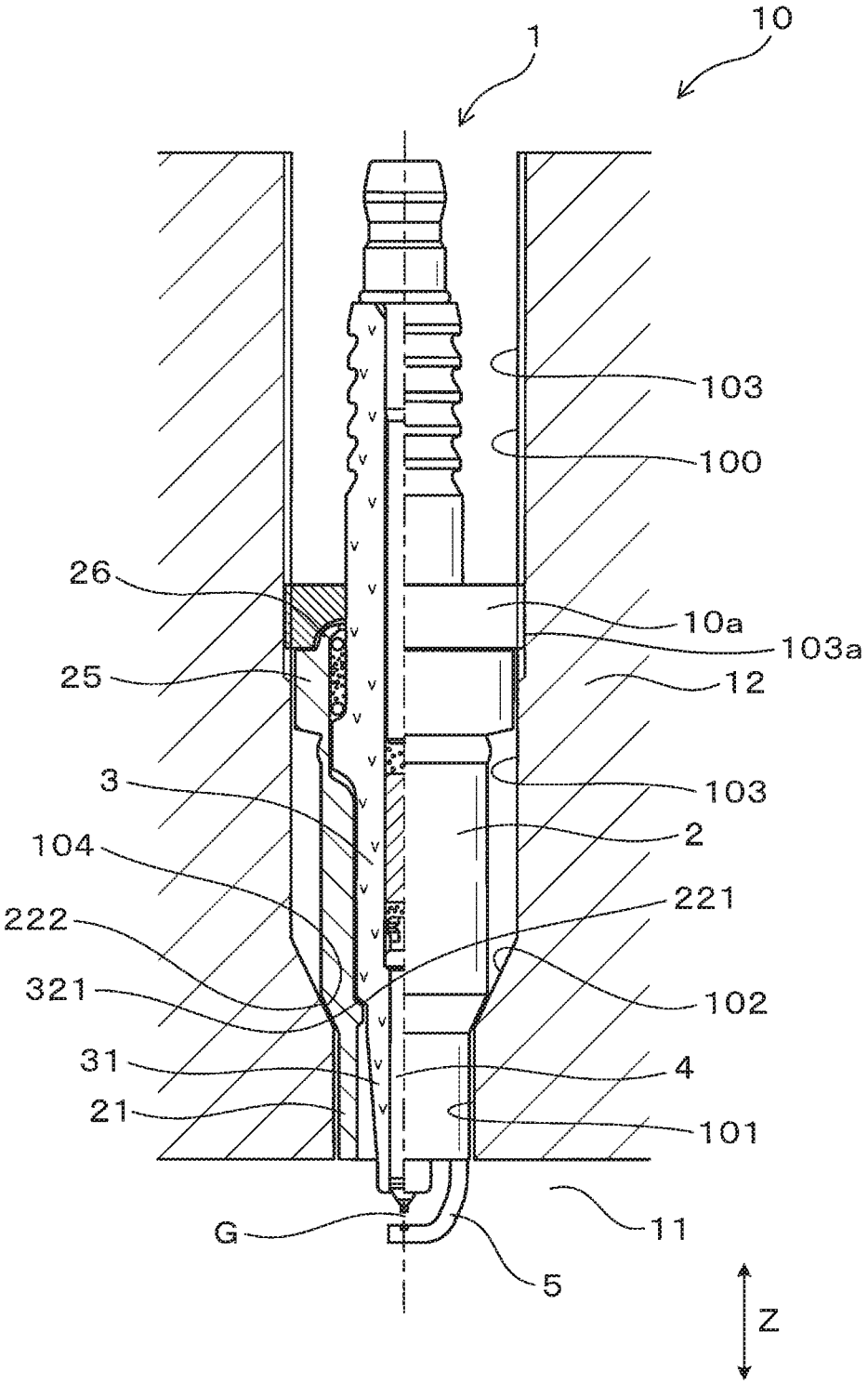
FIG. 2 is a front view showing a partial cross section of an ignition device using the spark plug shown in FIG. 1 according to the first exemplary embodiment of the present disclosure.
Figure 3:
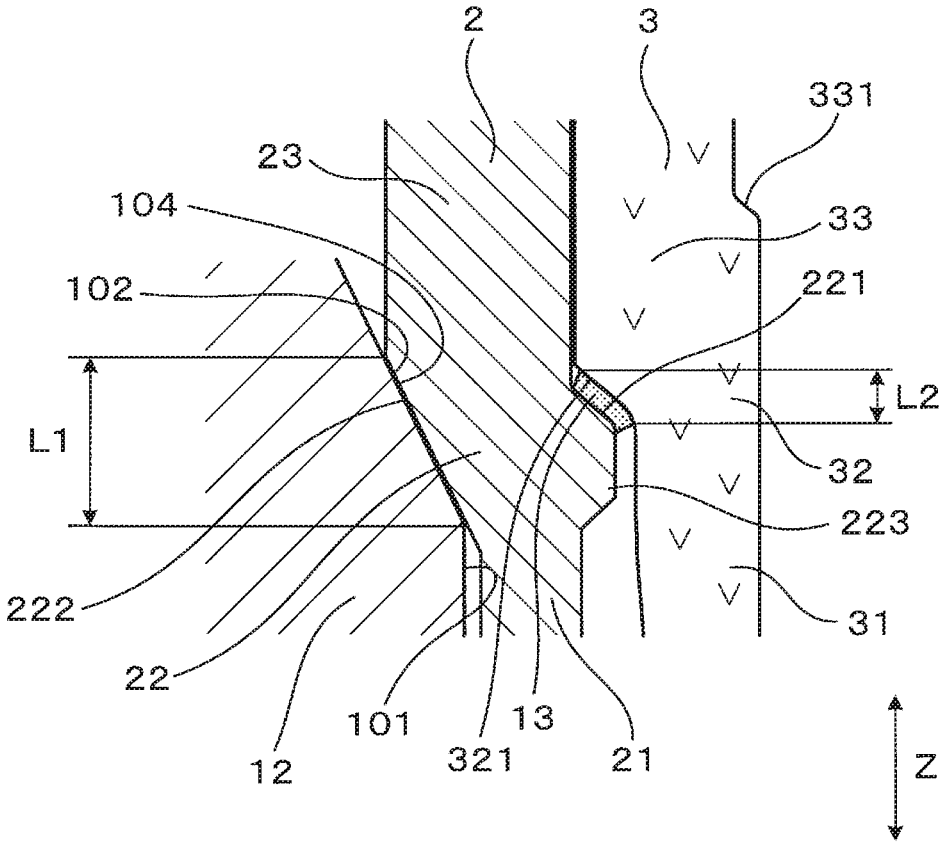
FIG. 3 is an enlarged view showing a part around a pressure fitting part of a spark plug housing (housing pressure fitting part), a housing support surface and an insulator support surface in the ignition device shown in FIG. 2.

As shown in FIG. 1, FIG. 2 and FIG. 3, the housing support surface 221 is formed on an inner peripheral surface of the spark plug housing 2. The insulator support surface 321 is formed on the outer peripheral surface of the insulator 3. The insulator support surface 321 is supported on the housing support surface 221 in an axial direction Z of the spark plug 1.

In particular, as shown in FIG. 2 and will be described later in detail, the spark plug housing 2 has the pressure fitting part 222 which is pressed and fitted into a cylinder head 12. A part of the pressure fitting part 222 and a part of at least one of the housing support surface 221 and the insulator support surface 321 are arranged to be overlapped with each other in the radial direction of the spark plug 1 and the ignition device 10.

A description will now be given of the detailed structure and effects of the spark plug 1 according to the first exemplary embodiment.

The spark plug 1 is applied to ignition devices of internal combustion engines of automobiles, internal combustion engines of co-generation systems, etc. One end terminal of the spark plug 1 in the axial direction Z is connected to an ignition coil (not shown), and the other end terminal of the spark plug 1 is connected to the combustion chamber 11 of the internal combustion engine shown in FIG. 2

The axial direction Z of the spark plug 1 is shown in FIG. 2. Through the specification, the axial direction Z represents the axial direction Z of the spark plug 1. The radial direction indicates the radial direction of the spark plug 1 and the circumference direction represents the circumference direction of the spark plug 1. In the axial direction Z, the front end part of the spark plug 1 is inserted into the combustion chamber 11, and the distal end part of the spark plug 1 is arranged at the side of an engine control unit (not shown).

The spark plug housing 2 has a cylindrical shape and is made of heat-resistant metal such as iron, nickel, iron and nickel alloy, stainless steel, etc. As shown in FIG. 1, the spark plug housing 2 is compose of a small diameter part 21, a slope part 22, a large diameter part 23 and a curved part 24, a protruding part 25 and a caulked part 26 arranged in order viewed from the front end side of the spark plug housing 2.

The small diameter part 21 has a cylindrical shape formed in the axial direction Z of the spark plug 1. The ground electrode 5 is connected to the front end surface of the small diameter part 21. As shown in FIG. 1, the small diameter part 21 is arranged at the front end side of the spark plug 1.

As shown in FIG. 1 and FIG. 3, the slope part 22 has the outer circumference surface on which the pressure fitting part 222 is formed. The pressure fitting part 222 has a taper shape in which a diameter of the pressure fitting part 222 is reduced radially inwardly toward the inner circumferential side of the spark plug housing 2 and the front end part in the axial direction Z of the spark plug housing 2. A length L1 of the pressure fitting part 222 in the axial direction Z is longer than a length L2 of the insulator support surface 321 in the axial direction Z.

In particular, the spark plug 1 has a structure in which a slope angle of the pressure fitting part 222 is not more than 45 degrees (45°) when viewed from a cross section of the spark plug 1, parallel to the axial direction Z passing through the central axis of the spark plug 1. This structure makes it possible to form the overall area of the pressure fitting part 222 as large as possible while suppressing the overall size of the spark plug 1 from increasing.

An inner peripheral projection part 223 is formed on an inner circumferential surface of the slope part 22 of the spark plug housing 2 so that the inner peripheral projection part 223 projects to an inward radius direction. The inner peripheral projection part 223 is formed on the overall area of the inner circumferential surface of the slope part 22. The surface of the inner peripheral projection part 223 at the distal end part thereof in the axial direction Z forms the housing support surface 221. The housing support surface 221 has a taper shape which is gradually sloped toward the inner circumferential side of the housing support surface 221 along the front end side of the axial direction Z of the spark plug 1. The housing support surface 221 faces the insulator support surface 321 of the insulator 3 in the ignition device 10 shown in FIG. 1 and FIG. 2.

As previously described, the insulator 3 is supported by the housing support surface 221 in the axial direction Z of the spark plug 1.

As shown in FIG. 1 and FIG. 3, the large diameter part 23 of the spark plug housing 2 is formed to have an outer diameter which is larger than the outer diameter of the small diameter part 21 of the spark plug housing 2. The large diameter part 23 has a cylindrical shape straight in the axial direction Z. As shown in FIG. 1, an opposing surface 231 is formed on the inner circumferential surface at the distal end part of the large diameter part 23. The opposing surface 231 has a taper shape which is sloped toward the outer circumferential side along the radial direction of the spark plug housing 2, i.e. toward the distal end side of the spark plug 1 in the axial direction Z. The opposing surface 231 is arranged facing a large diameter part 34 of the insulator 3.

As shown in FIG. 1, the curved part 24 is curved projecting toward the outer circumferential side of the spark plug housing 2. The outer circumferential surface of the curved part 24 has a thickness which is smaller than the thickness of the large diameter part 23 and the thickness of the protruding part 25 of the spark plug housing 2.

As shown in FIG. 1, the protruding part 25 is formed to have an outer diameter which is larger than the diameter of the large diameter part 23. The protruding part 25 projects toward the outer circumferential side of the spark plug housing 2 more than the outer side of each of the curved part 24 and the caulked part 26 arranged at both sides in the axial direction Z of the protruding part 25.

As shown in FIG. 1, the caulked part 26 is formed at the distal end part of the spark plug housing 2. The caulked part 26 has a curved shape which is curved radial inward toward the inner peripheral side of the spark plug housing 2. The caulked part 26 is arranged to press the insulator 3 toward the front end side of the spark plug housing 2 in the axial direction Z, which will be explained alter.

As shown in FIG. 1, the insulator 3 is supported in the inside of the spark plug housing 2. The insulator 3 is made of insulation material such as alumina. The insulator 3 has a leg part 31, a slope part 32, a medium diameter part 33, a maximum diameter part 34 and a distal end part 35.

As shown in FIG. 1, the outer diameter of the leg part 31 is gradually reduced toward the front end part of the insulator 3. The front end part of the leg part 31 projects more than the front end part of the spark plug housing 2. As shown in FIG. 2, the leg part 31 of the insulator 3 is exposed to the inside of the combustion chamber 11 when the spark plug 1 is mounted to the cylinder head 12 of the internal combustion engine.

As shown in FIG. 1 and FIG. 3, the slope part 32 of the insulator 3 has an outer diameter which gradually increases from the leg part 31 toward the distal end part of the insulator 3. The outer peripheral surface of the slope part 32 becomes the insulator support surface 321.

The insulator support surface 321 faces the front end side of the spark plug 1 in the axial direction Z. The insulator support surface 321 is arranged facing the housing support surface 221. In particular, the spark plug 1 has the structure in which the housing support surface 221, the insulator support surface 321 and the pressure fitting part 222 of the spark plug housing 2 are arranged to be overlapped together in the radial direction of the spark plug 1.

As shown in FIG. 3, a ring seal 13 (or ring packing) is arranged between the insulator support surface 321 and the housing support surface 221. That is, the insulator support surface 321 is supported by the housing support surface 221 through the ring seal 13. The ring seal 13 has a ring shape or an annular shape, and is made of a metal member having thermal conductivity.

As shown in FIG. 1, the medium diameter part 33 has an outer peripheral surface of a straight cylindrical shape in the axial direction Z.

The inner peripheral surface of the medium diameter part 33 has different diameter parts in the axial direction Z. An insulator step part 331 is formed between the different diameter parts of the medium diameter part 33.

In the inner peripheral surface of the medium diameter part 33, the distal end side of the medium diameter part 33 has an inner diameter which is larger than the inner diameter of the medium diameter part 33 at the front end side viewed from the insulator step part 331.

The insulator step part 331 has the inner diameter which gradually increases toward the distal end side in the axial direction Z. The insulator step part 331 has a surface facing toward the distal end side of the insulator 3 in the axial direction Z. In the axial direction Z, the insulator step part 331 is more arranged at the distal end side of the insulator 3 when compared with the location of the insulator support surface 321. The center electrode 4 is supported by the insulator step part 331 in the axial direction Z.

As shown in FIG. 1, the maximum diameter part 34 has an outer diameter which is larger than the outer diameter of the medium diameter part 33. The outer peripheral surface of the maximum diameter part 34 more projects toward the outer peripheral side when compared with both end parts (i.e. the medium diameter part 33 and the distal end part 35) of the maximum diameter part 34 in the axial direction Z of the insulator 3.

The maximum diameter part 34 is arranged at the inner peripheral side of the curved part 24 of the spark plug housing 2. The front end surface of the maximum diameter part 34 is sloped radially inwardly toward the front end side viewed in the axial direction Z. The front end surface of the maximum diameter part 34 faces the opposing surface 231 of the spark plug housing 2.

As shown in FIG. 1, the distal end part 35 substantially has a straight cylinder shape toward the distal end part from the maximum diameter part 34. The distal end part 35 has an inner part 351 and an outer part 352. The inner part 351 of the distal end part 35 is arranged in the inside of the spark plug housing 2. The outer part 352 of the distal end part 35 is exposed toward the distal end part of the spark plug housing 2. A corrugation part 352*a* is formed at the distal end part of the outer part 352. The corrugation part 352*a* has an outer peripheral surface of an uneven shape.

As shown in FIG. 1, a pair of ring parts 14 are arranged at both sides in the axial direction Z of an area surrounded by the maximum diameter part 34, the inner part 351 of the distal end part 35 and the spark plug housing 2. The pair of ring parts 14 are sealed with a filler powder 15. The ring parts 14 have a ring shape and are made of carbon steel. The pair of ring parts 14 are arranged to prevent the power filler 15 from being leaked outside from the inner part 351 of the distal end part 35, the spark plug housing 2, and the area surrounded by the pair of ring parts 14. For example, the filler powder 15 is made of talc. The insulator 3 and the spark plug housing 2 are completely sealed with the pair of ring parts 14 and the filler powder 15.

The caulked part 26 is caulked toward the front end side of the spark plug 1 so as to press the insulator 3 through the through the pair of ring parts 14 and the filler powder 15. The curved part 24 of the spark plug housing 2 is curved by the pressure applied to the spark plug housing 2 when the caulked part 26 is caulked toward the front end side of the spark plug 1 in a production step of producing the spark plug 1.

As shown in FIG. 1, the ground electrode 5 is joined with the front end surface of the spark plug housing 2, i.e. the front end surface of the small diameter part 21 of the spark plug housing 2.

The ground electrode 5 has a rod-shaped part 51 and an opposing part 52. The rod-shaped part 51 extends from the front end part of the spark plug housing 2 in the axial direction Z of the spark plug 1. The opposing part 52 is extended radially inwardly from the front end part of the rod-shaped part 51. The opposing part 52 is arranged facing the center electrode 4 in the axial direction Z. A discharge gap is formed in the axial direction Z between the opposing part 52 of the ground electrode 5 and the center electrode 4.

As shown in FIG. 1, the center electrode 4 is inserted in and supported by the inside of the insulator 3.

The center electrode 4 is made of a metal member such as Ni based alloy, etc. and has substantially a column shape. A metal member having superior thermal conductivity such as Cu is arranged in the inside of the center electrode 4.

A projection electrode part 41 is formed at the distal end part of the center electrode 4. The projection electrode part 41 has a diameter which is larger than the front end part of the projection electrode part 41. The surface of the projection electrode part 41 is contacted with the insulator step part 331 of the insulator 3 so as to support the center electrode 4 by the insulator 3.

As shown in FIG. 1, a resistance member 17 is arranged through a glass sealing member 16 having electrical conductivity at the distal end part of the center electrode 4 in the inside of the insulator 3. The resistance member 17 is produced by heating and sealing a resistance composition composed of a resistance such as carbon and glass powder. It is also possible to produce the resistance member 17 to insert a cartridge type resistance member into the inside of the insulator 3. The glass sealing member is made of copper glass. The copper glass is made of a mixture of glass and copper powder. A terminal metal fitting 6 is arranged at the distal end part of the resistance member 17 through the glass sealing member 16 made of copper glass.

The terminal metal fitting 6 is made of iron alloy, for example. The terminal metal fitting 6 has a projection part 61 which projects toward the distal end side of the insulator 3. The terminal metal fitting 6 has a diameter which is larger than a diameter of the part arranged inside of the insulator 3. The front end surface of the projection part 61 is in contact with the distal end surface of the insulator 3.

A description will now be given of the ignition device 10 according to the first exemplary embodiment.

As shown in FIG. 2, the ignition device 10 according to the first exemplary embodiment has the cylinder head 12, the spark plug 1 assembled with a plug hole 100 of the cylinder head 12, and a press member 10*a* which pushes the spark plug 1 toward the cylinder head 12.

As shown in FIG. 2, the plug hole 100 has a front end side opening end part and a distal end side opening part which are open in the axial direction Z. The front end side opening end part of the plug hole 100 communicates with the inside of the combustion chamber 11. The distal end side opening part of the plug hole 100 communicates with the distal end side of the ignition device 10. The spark plug 1 is inserted into the plug hole 100 through the distal end side opening part of the plug hole 100. The spark plug 1 is exposed to the inside of the combustion chamber 11 through the front end side opening end part of the plug hole 100. As shown in FIG. 2, the plug hole 100 has a small diameter part 101, a slope part 102 and a large diameter part 103.

As shown in FIG. 2, the small diameter part 101 has a straight cylindrical shape formed along the axial direction Z. The front end part of the small diameter part 101 is open to the combustion chamber 11 in the axial direction Z.

In the structure of the spark plug 1 according to the first exemplary embodiment, no female screw is formed on the inner peripheral surface of the small diameter part 101. The small diameter part 21 of the spark plug housing 2 is arranged in the inside of the small diameter part 101 of the plug hole 100. A small gap part is formed between the small diameter part 101 and the small diameter part 21 of the spark plug housing 2.

As shown in FIG. 2 and FIG. 3, the slope part 102 of the plug hole 100 has a taper shape which is tapered toward the outer peripheral side and the distal end side of the cylinder head 12. The inner peripheral surface of the slope part 102 faces the distal end side of the cylinder head 12. In particular, no female screw is formed in the slope part 102. The inner peripheral surface of the slope part 102 faces the pressure fitting part 222 of the spark plug housing 2 in the spark plug 1.

In the axial direction Z, the slope part 102 has a length which is longer than the pressure fitting part 222.

As shown in FIG. 2 and FIG. 3, the front end part of the inner peripheral surface of the slope part 102 has a head pressure fitting part 104. The pressure fitting part 222 of the spark plug housing 2 in the spark plug 1 is pressed to and fitted into the head pressure fitting part 104. That is, the surface of the spark plug housing 2 is pressed to the surface of the cylinder head 12 so as to be in contact with them. Other parts of the spark plug 1 and the cylinder head 12 are not pressed together and not in contact with together.

As shown in FIG. 2 and FIG. 3, the head pressure fitting part 104 has a taper shape, a diameter of which is reduced radially inwardly toward the inner peripheral side and the front end side in the axial direction Z. The head pressure fitting part 104 faces the pressure fitting part 222 of the spark plug housing 2. The head pressure fitting part 104 and the pressure fitting part 222 are fitted together around the overall circumference, and sealed together.

The inside of the combustion chamber 11 and the distal end part pf the plug hole 100 are sealed together when the head pressure fitting part 104 and the pressure fitting part 222 of the spark plug housing 2 are fitted together.

As shown in FIG. 2, the large diameter part 103 of the plug hole 100 has a straight cylindrical shape from the edge at the distal end side of the slope part 102 to the distal end side of the plug hole 100. The large diameter part 103 has the diameter which is larger than that of the small diameter part 101. The distal end side of the large diameter part 103 is open. The large diameter part 103 has a large-diameter screw hole 103*a* formed at the distal end side area viewed from the substantially central position of the large diameter part 103 in the axial direction Z. A female screw part is formed on the large-diameter screw hole 103*a*. No female screw part is formed at the front end side of the large-diameter screw hole 103*a*. The press member 10*a* is screwed and fitted into the large-diameter screw hole 103*a*.

As shown in FIG. 2, the press member 10*a* has a ring shape or annular shape. A male screw part is formed on the outer peripheral surface of the press member 10*a*. The male screw part of the press member 10*a* is screwed with the female screw part of the large diameter part 103. The front end part of the press member 10*a* has a shape which is fitted with the surface at the distal end side of the protruding part 25 and the outer peripheral surface of the caulked part 26 of the spark plug housing 2. The press member 10*a* is arranged to press the caulked part 26 and the protruding part 25 toward the front end side of the spark plug 1. This structure makes it possible to support the spark plug 1 in the axial direction by the head pressure fitting part 104 and the press member 10*a*.

In the manufacturing of the ignition device 10, the spark plug 1 is inserted into the plug hole 100, and the pressure fitting part 222 of the spark plug housing 2 is supported by the head pressure fitting part 104. Next, the press member 10*a* is assembled with the plug hole 100 from the distal end side of the spark plug 1. In this process, the spark plug 1 is inserted into the press member 10*a* and the press member 10*a* is assembled with the spark plug 1. The press member 10*a* is screwed with the female screw part formed in the large diameter part 103 until the spark plug 1 is in contact with the caulked part 26. After this, the press member 10*a* is screwed tightly with the female screw part formed in the large diameter part 103. This makes it possible to press the spark plug 1, i.e. the caulked part 26 and the protruding part 25 of the spark plug housing 2 toward the front end side of the cylinder head 12, i.e. toward the inside of the combustion chamber 11 while the press member 10*a* is tightly in contact with the caulked part 26 and the protruding part 25. In more detail, the spark plug 1 is tightly fitted with and supported by the area between the head pressure fitting part 104 and the press member 10*a*. That is, the spark plug 1 is fixed to the cylinder head 12.

A description will be given of behavior and effects of the spark plug 1 and the ignition device 10 according to the first exemplary embodiment.

The spark plug 1 according to the first exemplary embodiment has the structure in which the insulator support surface 321 is formed on the outer peripheral surface of the insulator 3, which is supported in the axial direction Z by the housing support surface 221 formed on the inner peripheral surface of the spark plug housing 2. This improved structure makes it possible to conduct thermal energy from the center electrode 4 and the insulator 3 supported by the spark plug housing 2 to the spark plug housing 2 through the insulator support surface 321 and the housing support surface 221. Further, because the spark plug housing 2 has the pressure fitting part 222 which is pressed toward and fitted into the cylinder head 12. The thermal energy conducted from the housing support surface 221 to the spark plug housing 2 is conducted to the pressure fitting part 222 in the spark plug housing 2, and finally conducted to the cylinder head 12 through the pressure fitting part 222.

Further, a part of the pressure fitting part 222 and a part of at least one of the housing support surface 221 and the insulator support surface 321 are arranged to be overlapped with each other in the radial direction of the spark plug 1 and the ignition device 10. This improved structure makes it possible to reduce a distance to the pressure fitting part 222 of the spark plug housing 2 from a thermally conductive part. The thermally conductive part is formed from the insulator support surface 321 to the housing support surface 221 (i.e. composed of the insulator support surface 321, the ring seal 13 (or the ring packing) and the housing support surface 221 of the spark plug housing 2. This structure reduces the thermal energy conductive distance from the thermally conductive part to the pressure fitting part 222 of the spark plug housing 2. In other words, this structure makes it possible to easily and effectively discharge thermal energy from the insulator 3 and the center electrode 4, etc. in the spark plug housing 2 to the cylinder head 12.

Further, this structure of the spark plug 1 makes it possible to suppress a temperature of the resistance member 17 arranged in the inside of the insulator 3 from increasing. This can suppress oxidation and burning of carbon component contained in the resistance member 17 due to a high temperature of the resistance member 17. Still further, this can suppress a resistance value of the resistance member 17 from increasing due to the deterioration of the carbon component contained in the resistance member 17. It is accordingly possible to prevent misfire of the internal combustion engine from occurring due to increasing of a resistance value of the resistance member 17.

Still further, the pressure fitting part 222 has a taper shape, a diameter of which is gradually reduced radially inwardly toward the front end side in the axial direction Z of the spark plug housing 2. This structure makes it possible to suppress an overall size of the spark plug housing 2 from increasing while maintaining the overall area of the pressure fitting part 222. This makes it possible to suppress the overall size of the spark plug 1 from increasing and to enhance the discharging capability of thermal energy from the spark plug housing 2 to the cylinder head 12.

Still further, this improved structure makes it possible to suppress occurrence of thermal expansion of the spark plug housing 2 by the improved discharging capability of thermal energy from the spark plug housing 2 to the cylinder head 12. This makes it possible to prevent loss of airtightness between the insulator 3 and the spark plug housing 2 due to release of the caulked part 26 due to the thermal expansion of the spark plug housing 2.

Furthermore, during the assembling step of the spark plug 1 with the plug hole 100, because the pressure fitting part 222 having a taper shape is smoothly slide on the inner wall surface of the plug hole 100, this makes it possible to determine the correct position of the spark plug 1 in the plug hole 100 with high accuracy in the radial direction. This allows the spark plug 1 and the plug hole 100 to be easily assembled together with high accuracy.

Further, because the pressure fitting part 222 has the structure in which the length L1 of the pressure fitting part 222 in the axial direction Z is longer than that of the insulator support surface 321 of the insulator 3, it is possible to easily maintain the necessary contact area between the pressure fitting part 222 and the head pressure fitting part 104 of the plug hole 100 of the cylinder head 12. This structure makes it possible to increase the discharging capability of thermal energy from the spark plug housing 2 to the cylinder head 12.

In the ignition device 10 according to the first exemplary embodiment, each of the pressure fitting part 222 and the head pressure fitting part 104 has a taper shape, the diameter of which is reduced radially inwardly toward the inner peripheral side and the front end side in the axial direction Z. Further, the head pressure fitting part 104 of the cylinder head 12 and the pressure fitting part 222 of the spark plug housing 2 face with each other. This structure makes it possible to easily keep the contact area between the pressure fitting part 222 and the head pressure fitting part 104. This structure improves and increases the discharging capability of thermal energy from the spark plug housing 2 to the cylinder head 12. Further, this structure makes it possible to prevent occurrence of a collision of the front end part (for example, the ground electrode 5) of the spark plug 1 with the inner peripheral surface, i.e. the inner wall surface of the plug hole 100.

Further, in the improved structure of the ignition device 10 according to the first exemplar y embodiment, the press member 10*a* pushes the caulked part 26 of the spark plug 1. When thermal expansion of the caulked part 26 occurs to the direction to release the insulator 3, the press member 10*a* suppresses the deformation of the caulked part 26. This makes it possible to prevent loss of airtightness between the insulator 3 and the spark plug housing 2 from increasing due to the release of the insulator 3 from the caulked part 26.

As previously described in detail, the first exemplary embodiment provides the spark plug 1, without any screw structure to be screwed and fitted into the plug hole of the cylinder head of an internal combustion engine, having the improved thermal energy discharging capability to the cylinder head. Further, the first exemplary embodiment provides the ignition device 10 equipped with the spark plug 1 for internal combustion engines having the improved thermal energy discharging capability to the cylinder head.

Second Exemplary Embodiment

A description will be given of the spark plug and the ignition device according to a second exemplary embodiment with reference to FIG. 4.

Figure 4:
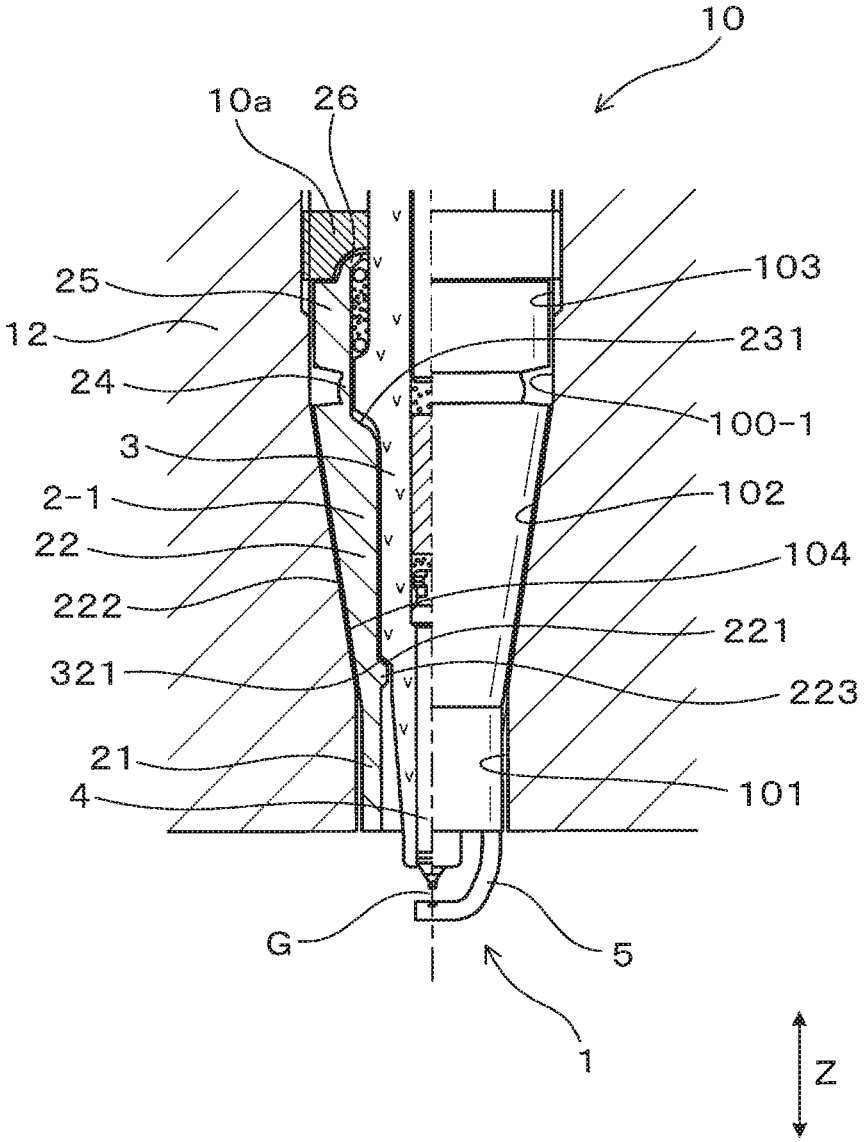
FIG. 4 is a front view showing a partial cross section of the ignition device using the spark plug according to a second exemplary embodiment of the present disclosure.

FIG. 4 is a front view showing a partial cross section of the ignition device 10 using the spark plug 1 according to the second exemplary embodiment of the present disclosure. As shown in FIG. 4, the spark plug 1 according to the second exemplary embodiment has a spark plug housing 2-1 and a plug hole 100-1 which are different in structure from the spark plug housing 2-1 and the plug hole 100 in the spark plug 1 according to the first exemplary embodiment.

In the structure of the ignition device 10 shown in FIG. 4, the spark plug housing 2-1 is compose of the small diameter part 21, the slope part 22, the curved part 24, the protruding part 25 and the caulked part 26 arranged in order viewed from the front end side of the spark plug housing 2-1.

In particular, the spark plug housing 2-1 shown in FIG. 4 does not have the large diameter part 23 when compared with the structure of the spark plug housing 2 shown in FIG. 1. That is, the spark plug housing 2-1 shown in FIG. 4 has no large diameter part.

The slope part 22 of the spark plug housing 2-1 has a longitudinal shape in the axial direction Z. The slope part 22 has a length which is longer in the axial direction Z than the length of the small diameter part 21. The overall outer peripheral surface of the slope part 22 substantially forms the pressure fitting part 222 of the spark plug housing 2-1. That is, in the structure of the spark plug 1 according to the second exemplary embodiment, the overall outer peripheral surface of the slope part 22 is substantially pressed to and in contact with the head pressure fitting part 104 of the plug hole 100-1 of the cylinder head 12.

In the structure of the ignition device 10 shown in FIG. 4, the inner peripheral projection part 223, the housing support surface 221 and the insulator support surface 321 are formed on the inner peripheral surface at the front end side in the axial direction Z of the slope part 22 of the spark plug housing 2-1. In the axial direction Z, the slope part 22 is formed from the front end side of the inner peripheral projection part 223 toward the curved part 24 (at the distal end side of the spark plug housing 2-1). In the structure of the spark plug housing 2-1, the slope part 22 has the same diameter of the protruding part 25.

In the structure of the ignition device according to the second exemplary embodiment shown in FIG. 4, the opposing surface 231 is formed on the inner peripheral surface at the distal end side of the slope part 22 of the spark plug housing 2-1. As shown in FIG. 4, the curved part 24 is formed radially inwardly in the radial direction when compared with the parts (i.e. the large diameter part 23 and the protruding part 25 shown in FIG. 1) at both end parts of the curved part 24 of the spark plug housing 2-1.

The slope part 102 of the plug hole 100-1 has a longitudinal shape in the axial direction Z. The inner peripheral surface of the slope part 102 is arranged facing the pressure fitting part 222 of the spark plug housing 2-1 in the spark plug 1.

In the axial direction Z, the slope part 102 of the plug hole 100-1 has the same length as the slope part 22 of the spark plug housing 2-1. The overall inner peripheral surface of the slope part 102 of the plug hole 100-1 is substantially in contact with the pressure fitting part 222 of the spark plug housing 2-1. That is, the overall area of the inner peripheral surface of the slope part 102 of the plug hole 100-1 substantially forms the head pressure fitting part 104 of the cylinder head 12.

Other components of the ignition device according to the second exemplary embodiment shown in FIG. 4 are the same as those of the ignition device according to the first exemplary embodiment shown in FIG. 1 to FIG. 3. Accordingly, the same components will be referred to with the same reference numbers and characters and the explanation of the same components is omitted here for brevity.

In the structure of the ignition device according to the second exemplary embodiment shown in FIG. 4, the slope part 22 of the spark plug housing 2-1 is formed from the front end side of the inner peripheral projection part 223 in the axial direction Z to the position before the curved part 24 (i.e. at the distal end side of the spark plug housing 2-1).

The spark plug 1 is forcedly pressed to the head pressure fitting part 104 of the plug hole 100-1 in the overall outer peripheral surface of the slope part 22 of the spark plug housing 2-1. This structure makes it possible to maintain the effective contact area between the pressure fitting part 222 and the head pressure fitting part 104. This structure improves the thermal energy discharging capability from the spark plug housing 2-1 to the cylinder head 12. In addition to the features previously described, the ignition device according to the second exemplary embodiment shown in FIG. 4 has the same behavior and effects of the ignition device according to the first exemplary embodiment shown in FIG. 1 to FIG. 3.

Third Exemplary Embodiment

A description will be given of the spark plug and the ignition device according to a third exemplary embodiment with reference to FIG. 5.

Figure 5:
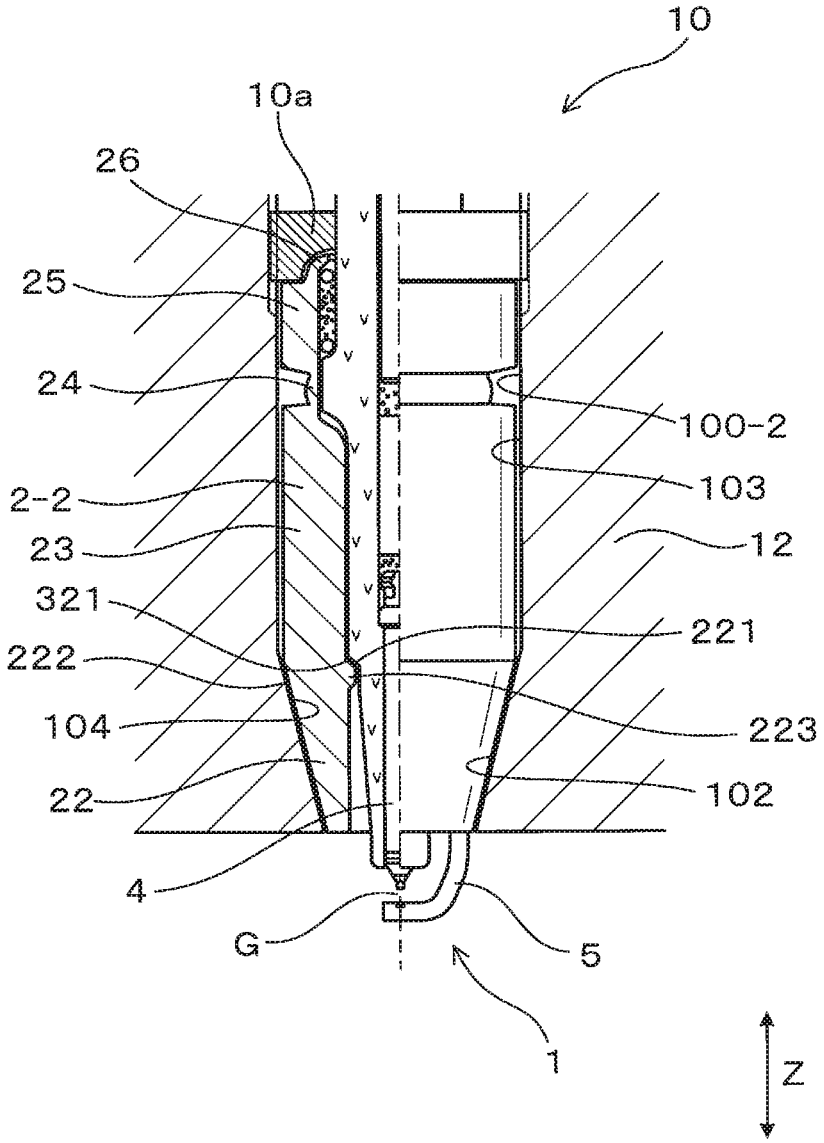
FIG. 5 is a front view showing a partial cross section of the ignition device using the spark plug according to a third exemplary embodiment of the present disclosure.

FIG. 5 is a front view showing a partial cross section of the ignition device 10 according to the third exemplary embodiment of the present disclosure. As shown in FIG. 5, the ignition device 10 according to the third exemplary embodiment has the spark plug housing 2-2 and the plug hole 100-2 which are different in structure from the spark plug housing 2 and the plug hole 100 in the ignition device 10 according to the first exemplary embodiment shown in FIG. 1.

In the structure of the ignition device 10 shown in FIG. 5, the spark plug housing 2-2 is compose of the slope part 22, the large diameter part 23, the curved part 24, the protruding part 25 and the caulked part 26 arranged in order viewed from the front end side of the spark plug housing 2-2. In particular, the spark plug housing 2-2 shown in FIG. 5 does not have the small diameter part 21 when compared with the structure of the spark plug housing 2 shown in FIG. 1. That is, the spark plug housing 2-2 shown in FIG. 5 has no small diameter part. The slope part 22 forms the front end part of the spark plug housing 2-2.

The slope part 22 of the spark plug housing 2-2 has a longitudinal shape in the axial direction Z. The slope part 22 has a length which is longer in the axial direction Z than the length of the protruding part 25. The overall outer peripheral surface of the slope part 22 substantially forms the pressure fitting part 222 of the spark plug housing 2-2. That is, in the structure of the spark plug 1 according to the third exemplary embodiment, the overall outer peripheral surface of the slope part 22 is substantially pressed and in contact with the head pressure fitting part 104 of the plug hole 100-2 of the cylinder head 12.

In the structure of the ignition device 10 shown in FIG. 5, the inner peripheral projection part 223, the housing support surface 221 and the insulator support surface 321 are formed on the inner peripheral surface at the distal end side in the axial direction Z of the slope part 22 of the spark plug housing 2-2. In the axial direction Z, the slope part 22 is formed from the distal end side of the inner peripheral projection part 223 to the front end surface of the spark plug housing 2-2. In the structure of the spark plug housing 2-2, the large diameter part 23 has the same diameter as the protruding part 25. In the structure of the ignition device according to the third exemplary embodiment shown in FIG. 5, the curved part 24 is formed on the inner peripheral surface at the distal end side of the slope part 22 of the spark plug housing 2-1. As shown in FIG. 4, the curved part 24 is formed at the inner peripheral side in the radial direction of the spark plug housing 2-2 when compared with both sides of the curved part 24 (i.e. compared with the position of the large diameter part 23 and the protruding part 25).

The plug hole 100-2 has the slope part 102 and the large diameter part 103 which are arranged, i.e. formed in order viewed from the front end side of the plug hole 100-2. As shown in FIG. 5, the plug hole 100-2 does not have the small diameter part 101 which is formed in the plug hole 100 shown in FIG. 2.

As shown in FIG. 5, the slope part 102 is formed from the front end side toward the distal end side of the plug hole 100-2. The slope part 102 has a longitudinal shape in the axial direction Z. the slope part 102 is arranged facing the pressure fitting part 222 of the spark plug housing 2-2.

In the axial direction Z, the slope part 102 of the plug hole 100-2 has the same length as the slope part 22 of the spark plug housing 2-2. The overall inner peripheral surface of the slope part 102 of the plug hole 100-2 is substantially in contact with the pressure fitting part 222 of the spark plug housing 2-2. That is, the overall area of the inner peripheral surface of the slope part 102 of the plug hole 100-2 substantially forms the head pressure fitting part 104 of the cylinder head 12.

Other components of the ignition device according to the third exemplary embodiment shown in FIG. 5 are the same as those of the ignition device according to the first exemplary embodiment shown in FIG. 1 to FIG. 3. Accordingly, the same components will be referred to with the same reference numbers and characters and the explanation of the same components is omitted here for brevity.

In the structure of the ignition device according to the third exemplary embodiment shown in FIG. 5, the slope part 22 is formed at the front end side of the spark plug housing 2-2. The substantial overall outer peripheral surface of the slope part 22 forms the pressure fitting part 222. This structure makes it possible to arrange the pressure fitting part 222 at the front end side of the spark plug housing 2-2. This improved structure allows thermal energy at the front end side of the spark plug 1 to be quickly conducted to the cylinder head 12. Accordingly, the ignition device according to the third exemplary embodiment has the improved thermal energy discharging capability of the spark plug housing 2-2 to the cylinder head 12.

In the structure of the ignition device according to the third exemplary embodiment shown in FIG. 5, the slope part 22 of the spark plug housing 2-2 is formed from the distal end side of the inner peripheral projection part 223 in the axial direction Z to the front end side of the spark plug housing 2-2. As previously described, the substantial overall outer peripheral surface of the slope part 22 forms the pressure fitting part 222. This structure makes it possible to maintain the effective contact area between the pressure fitting part 222 and the head pressure fitting part 104. This structure improves the thermal energy discharging capability from the spark plug housing 2-2 to the cylinder head 12. In addition to the features previously described, the ignition device according to the third exemplary embodiment shown in FIG. 5 has the same behavior and effects of the ignition device according to the first exemplary embodiment shown in FIG. 1 to FIG. 3.

Fourth Exemplary Embodiment

A description will be given of the spark plug and the ignition device according to a fourth exemplary embodiment with reference to FIG. 6.

Figure 6:
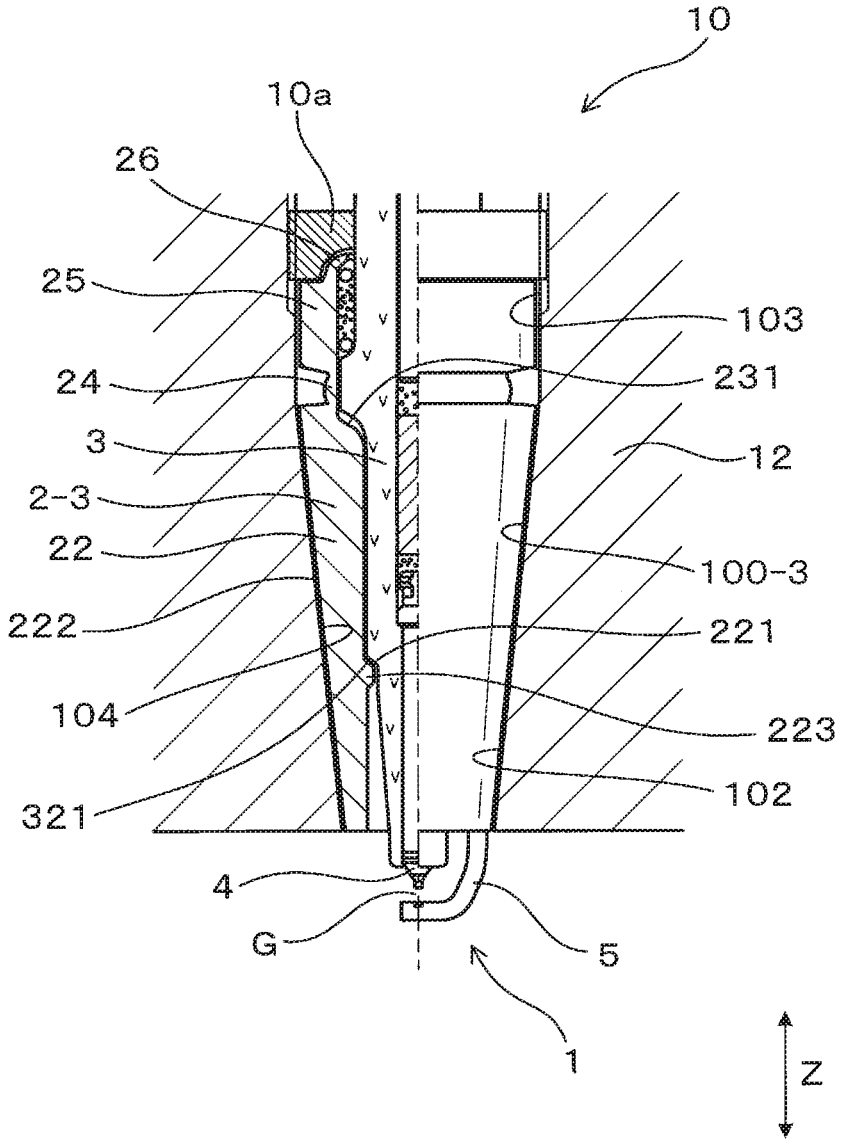
FIG. 6 is a front view showing a partial cross section of the ignition device using the spark plug according to a fourth exemplary embodiment of the present disclosure.

FIG. 6 is a front view showing a partial cross section of the ignition device using the spark plug according to the fourth exemplary embodiment. In the ignition device 10 according to the fourth exemplary embodiment shown in FIG. 6, the spark plug housing 2-3 and the plug hole 100-3 are different structure from the spark plug housing 2 and the plug hole 100 in the ignition device 10 according to the first exemplary embodiment shown in FIG. 1.

In the structure of the ignition device 10 shown in FIG. 6, the spark plug housing 2-3 is compose of the slope part 22, the curved part 24, the protruding part 25 and the caulked part 26 arranged in order viewed from the front end side of the spark plug housing 2-3.

In particular, the spark plug housing 2-3 shown in FIG. 6 does not have the small diameter part 21 and the large diameter part 23 when compared with the structure of the spark plug housing 2 shown in FIG. 1. That is, the slope part 22 is formed at the front end side of the curved part in the spark plug housing 2-3. The slope part 22 forms the front end part of the spark plug housing 2-3 shown in FIG. 6.

The slope part 22 of the spark plug housing 2-3 has a longitudinal shape in the axial direction Z. The slope part 22 has a length which is not less than a halt of the overall length of spark plug housing 2-3. The overall outer peripheral surface of the slope part 22 substantially forms the pressure fitting part 222 of the spark plug housing 2-3. That is, in the structure of the spark plug 1 according to the fourth exemplary embodiment, the overall outer peripheral surface of the slope part 22 is substantially pressed to and in contact with the head pressure fitting part 104 of the plug hole 100-3 of the cylinder head 12.

In the structure of the ignition device 10 shown in FIG. 6, the inner peripheral projection part 223, the housing support surface 221 and the insulator support surface 321 are formed on the inner peripheral surface in the axial direction Z of the slope part 22 of the spark plug housing 2-3.

In the structure of the spark plug housing 2-3, the distal end part of the slope part 22 has the same diameter as the protruding part 25. In the structure of the ignition device according to the fourth exemplary embodiment shown in FIG. 6, the opposing surface 231 is formed on the inner peripheral surface at the distal end side of the slope part 22 of the spark plug housing 2-3. As shown in FIG. 6, the curved part 24 is formed radially inwardly in the radial direction when compared with the parts (i.e. the large diameter part 23 shown in FIG. 1 and the protruding part 25 shown in FIG. 6) at both end parts of the curved part 24 of the spark plug housing 2-3.

The plug hole 100-3 has the slope part 102 and the large diameter part 103 which are arranged, i.e. formed in order viewed from the front end side of the plug hole 100-3. As shown in FIG. 6, the plug hole 100-3 does not have the small diameter part 101 which is formed in the plug hole 100 shown in FIG. 2.

As shown in FIG. 6, the slope part 102 is formed from the front end side toward the distal end side of the plug hole 100-3. The slope part 102 has a longitudinal shape in the axial direction Z. The slope part 102 is arranged facing the pressure fitting part 222 of the spark plug housing 2-3.

In the axial direction Z, the slope part 102 of the plug hole 100-3 has the same length as the slope part 22 of the spark plug housing 2-3. The overall inner peripheral surface of the slope part 102 of the plug hole 100-3 is substantially in contact with the pressure fitting part 222 of the spark plug housing 2-2. That is, the overall area of the inner peripheral surface of the slope part 102 of the plug hole 100-3 substantially forms the head pressure fitting part 104 of the cylinder head 12.

Other components of the ignition device according to the fourth exemplary embodiment shown in FIG. 6 are the same as those of the ignition device according to the first exemplary embodiment shown in FIG. 1 to FIG. 3. Accordingly, the same components will be referred to with the same reference numbers and characters and the explanation of the same components is omitted here for brevity.

In the structure of the ignition device according to the fourth exemplary embodiment shown in FIG. 6, the slope part 22 forms the front end side of the spark plug housing 2-3. The overall outer peripheral surface of the slope part 22 of the spark plug housing 2-3 substantially forms the pressure fitting part 222. This structure allows the pressure fitting part 222 to be formed at the front end part of the spark plug housing 2-3. Accordingly, this improved structure allows thermal energy from the combustion chamber 11 and the front end side of the spark plug 1 to be quickly conducted to the cylinder head 12 through the pressure fitting part 222 formed at the front end side of the spark plug housing 2-3 and the head pressure fitting part 104 of the cylinder head 12. The ignition device according to the fourth exemplary embodiment has the improved thermal energy discharging capability of the spark plug to the cylinder head 12.

Further, in the ignition device according to the fourth exemplary embodiment, the slope part 22 forms the front end part of the curved part 24 of the spark plug housing 2-3, and the overall area of the outer peripheral surface of the slope part 22 forms the pressure fitting part 222. This structure makes it possible to easily keep the contact area between the pressure fitting part 222 and the head pressure fitting part 104 of the cylinder head 12. Accordingly, this structure improves the thermal energy discharging capability from the spark plug housing 2-3 to the cylinder head 12. In addition to the features previously described, the ignition device according to the fourth exemplary embodiment shown in FIG. 6 has the same behavior and effects of the ignition device according to the first exemplary embodiment shown in FIG. 1 to FIG. 3.

Fifth Exemplary Embodiment

A description will be given of the spark plug and the ignition device according to a fifth exemplary embodiment with reference to FIG. 7.

Figure 7:
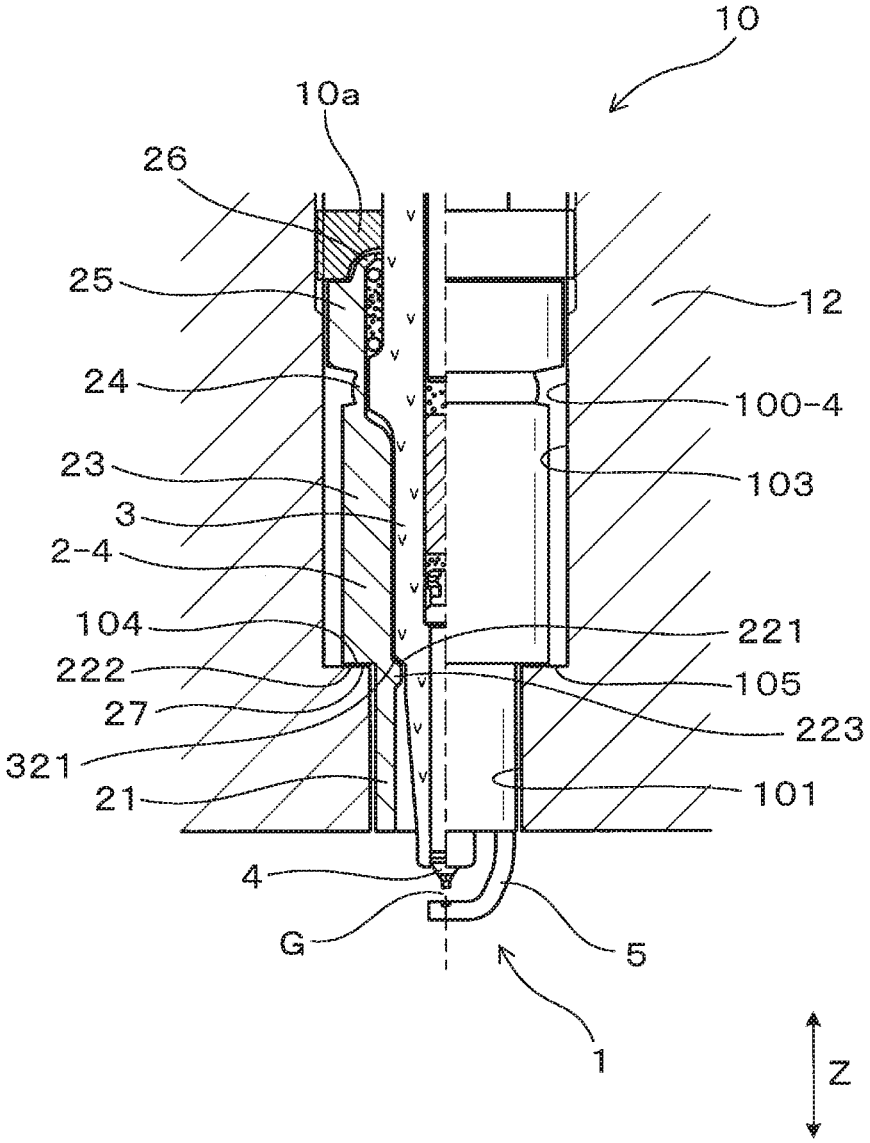
FIG. 7 is a front view showing a partial cross section of the ignition device using the spark plug according to a fifth exemplary embodiment of the present disclosure.

FIG. 7 is a front view showing a partial cross section of the ignition device using the spark plug according to the fifth exemplary embodiment of the present disclosure. As shown in FIG. 7, the ignition device 10 according to the fifth exemplary embodiment has the spark plug housing 2-4 and the plug hole 100-4 which are different in structure from the spark plug housing 2 and the plug hole 100 in the ignition device 10 according to the first exemplary embodiment shown in FIG. 1.

In the structure of the ignition device 10 shown in FIG. 7, the spark plug housing 2-4 is compose of the small diameter part 21, a step part 27, the large diameter part 23, the curved part 24, the protruding part 25 and the caulked part 26 arranged in order viewed from the front end side of the spark plug housing 2-4.

In particular, the spark plug housing 2-4 shown in FIG. 7 does not have the slope part 22 when compared with the structure of the spark plug housing 2 shown in FIG. 1. That is, the step part 27 is formed between the small diameter part 21 and the large diameter part 23 in the spark plug housing 2-4.

The step part 27 of the spark plug housing 2-4 shown in FIG. 7 has a ring shape or an annular shape through which the large diameter part 23 and the front end part on the outer peripheral surface of the large diameter part 23 and the distal end part on the outer peripheral surface of the small diameter part 21 are joined together in the radius direction of the spark plug 1. The step part 27 has a plane shape when viewed in a direction which is perpendicular to the axial direction Z. The step part 27 is arranged in the axial direction facing the front end side of the spark plug housing 2-4. A part of the step part 27 excepting the inner peripheral edges thereof forms the pressure fitting part 222. That is, this structure makes it possible to easily keep the contact area between the pressure fitting part 222 and the head pressure fitting part 104 of the cylinder head 12. Accordingly, the spark plug excepting the inner peripheral edges of the step part 27 according to the fifth exemplary embodiment shown in FIG. 7 is pressed and in contact with the head pressure fitting part 104 of the plug hole 100-4.

In the structure of the ignition device according to the fifth exemplary embodiment shown in FIG. 7, the inner peripheral projection part 223, the housing support surface 221 and the insulator support surface 321 are formed on the inner peripheral surface of the step part 27.

As shown in FIG. 7, the step part 27 is formed in the spark plug housing 2-4 so that the outer diameter of the step part 27 is greater than the outer diameter of the curved part 24, and smaller than the outer diameter of the protruding part 25. The curved part 24 is formed at the inner peripheral side in the radial direction of the spark plug housing 2-4 when compared with both sides of the curved part 24 (i.e. compared with the position of the large diameter part 23 and the protruding part 25).

The plug hole 100-4 has the small diameter part 101, a step part 105 and the large diameter part 103 which are arranged, i.e. formed in order viewed from the front end side of the plug hole 100-4. As shown in FIG. 7, the plug hole 100-4 does not have the slope hole 102 which is formed in the plug hole 100 shown in FIG. 2, and the step part 105 is formed between the small diameter part 101 and the large diameter part 103.

The step part 105 has a ring shape, i.e. an annular shape through which the distal end side of the small diameter part 101 is connected to the front end side of the large diameter part 103. The step part 105 has a plane shape in the direction which is perpendicular to the axial direction Z. The step part 105 faces the distal end side of the spark plug housing 2-4 viewed from the axial direction Z. The step part 105 faces the pressure fitting part 222 of the spark plug housing 2-4. A part, which is substantially measured from a central part toward the inner peripheral side, of the step part 105 of the plug hole 100-4 is in contact with the pressure fitting part 222 of the spark plug housing 2-4. That is, the plug hole 100-4 has the structure in which the part, which is substantially measured from a central part toward the inner peripheral side, of the step part 105, forms the head pressure fitting part 104.

Other components of the ignition device according to the fifth exemplary embodiment shown in FIG. 7 are the same as those of the ignition device according to the first exemplary embodiment shown in FIG. 1 to FIG. 3. Accordingly, the same components will be referred to with the same reference numbers and characters and the explanation of the same components is omitted here for brevity.

In the improved structure of the ignition device equipped with the spark plug according to the fifth exemplary embodiment, because the pressure fitting part 222 of the spark plug housing 2-4 and the head pressure fitting part 104 of the plug hole 100-4 are arranged on the same plane which is perpendicular to the axial direction, it is possible to easily produce the ignition device 10 equipped with the spark plug according to the fifth exemplary embodiment.

Sixth Exemplary Embodiment

A description will be given of the spark plug and the ignition device according to a sixth exemplary embodiment with reference to FIG. 8.

Figure 8:
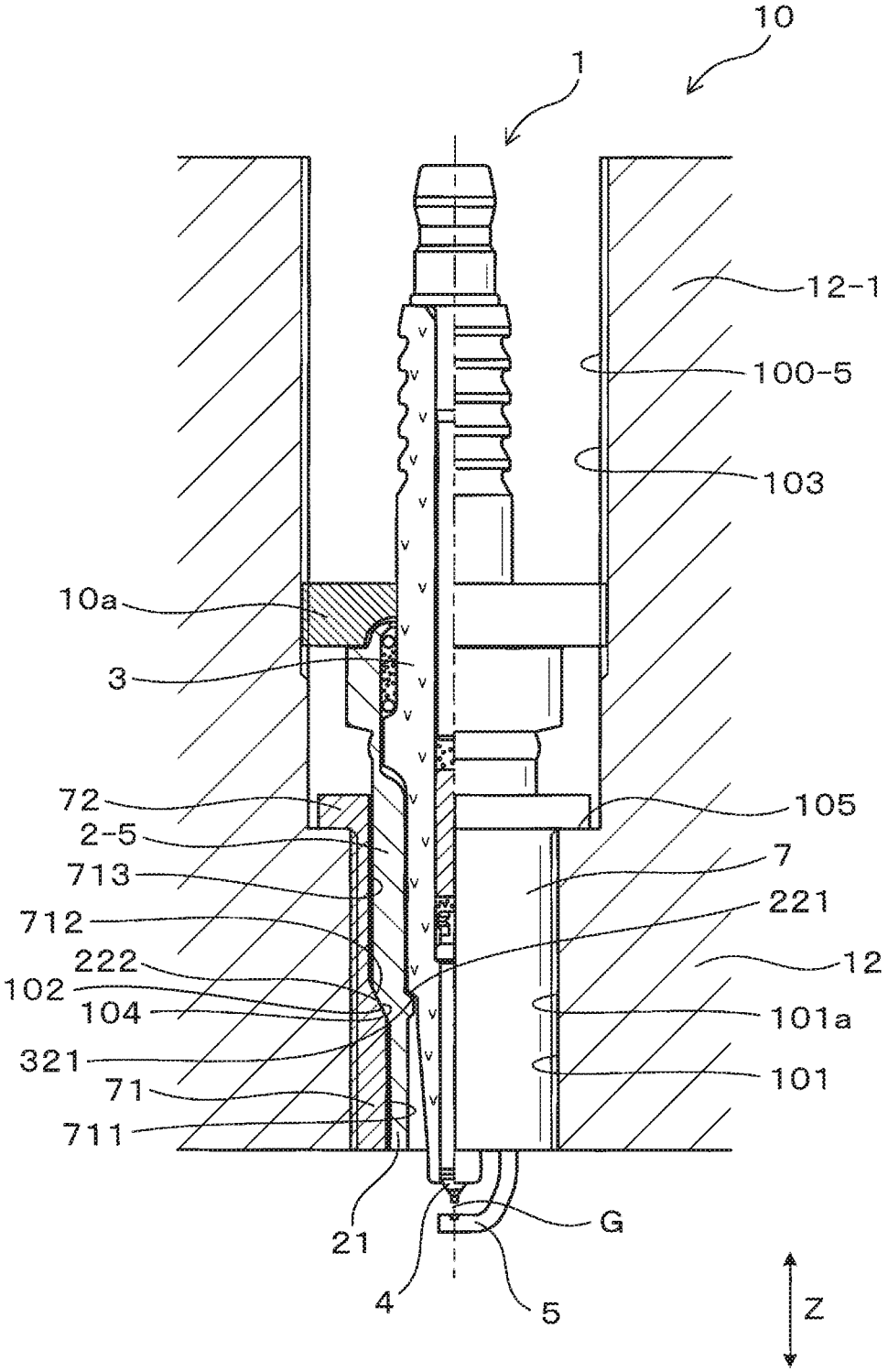
FIG. 8 is a front view showing a partial cross section of the ignition device using the spark plug according to a sixth exemplary embodiment of the present disclosure.

FIG. 8 is a front view showing a partial cross section of the ignition device using the spark plug according to the sixth exemplary embodiment of the present disclosure. As shown in FIG. 8, the ignition device 10 according to the sixth exemplary embodiment has a cylinder head 12-1 which is different in structure from the cylinder head 12 in the ignition device 10 according to the first exemplary embodiment shown in FIG. 1.

In the ignition device using the spark plug according to the sixth exemplary embodiment shown in FIG. 8, the plug hole 100-5 has the small diameter part 101, the step part 105 and the large diameter part 103 which are arranged, i.e. formed in order viewed from the front end side of the plug hole 100-5. As shown in FIG. 8, the plug hole 100-5 does not have the slope part 102 which is formed in the plug hole 100 shown in FIG. 2. As shown in FIG. 8, the step part 105 is formed between the small diameter part 101 and the large diameter part 103.

The step part 105 has a ring shape, i.e. an annular shape through which the distal end side of the small diameter part 101 is connected to the front end side of the large diameter part 103. The step part 105 has a plane shape in the direction which is perpendicular to the axial direction Z. The step part 105 faces the distal end side of the spark plug housing 2-4 viewed from the axial direction Z.

A female screw part is formed in a front-side female screw part 101*a* at the front end part of the plug hole 100-5. In the sixth exemplary embodiment shown in FIG. 8, the small diameter part 101 has the front-side female screw part 101*a*. The cylinder head 12-1 has an intermediate member 7 having thermal conductivity which is screwed with the front-side female screw part 101*a* of the plug hole 100-5. The head pressure fitting part 104 is formed on the inner peripheral surface of the intermediate member 7. No female screw part is formed on the inner peripheral surface of the intermediate member 7.

The intermediate member 7 has a cylindrical shaped part 71 and a flange part 72. The flange part 72 is formed at the distal end side of the cylindrical shaped part 71. A male screw part is formed on the outer peripheral surface of the cylindrical shaped part 71 so as to be screwed with the front-side female screw part 101*a* of the plug hole 100-5.

A small diameter hole part 711, a slope hole part 712 and a large diameter hole part 713 are formed in order from the front end side of the intermediate member 7.

The small diameter hole part 711 has a straight cylindrical shape formed along the axial direction Z. The front end part of the small diameter part 711 is open to the combustion chamber 11 in the axial direction Z.

The small diameter part 21 of the spark plug housing 2-5 of the spark plug 1 is arranged in the inside of the small diameter hole part 711. A gap is formed between the small diameter hole part 711 of the small diameter hole part 71 of the intermediate member 7 and the small diameter part 21 of the spark plug housing 2-5.

The slope hole part 712 of the cylindrical shaped part 71 has a tapered shape expanding toward the outer peripheral side in the radial direction viewed toward the distal end side of the intermediate member 7. The inner peripheral surface of the slope hole part 712 faces the distal end side of the intermediate member 7. The overall inner peripheral surface of the slope hole part 712 substantially forms the head pressure fitting part 104. This head pressure fitting part 104 is arranged facing the pressure fitting part 222 of the spark plug housing 2-5.

The large diameter hole part 713 has a straight cylindrical shape formed from the edge part of the slope part 102 to the distal end side of the intermediate member 7.

The large diameter hole part 713 has a diameter which is larger than that of the small diameter hole part 711. The distal end part of the large diameter hole part 713 is open.

The large diameter part 23 of the spark plug housing 2-5 is arranged in the inside of the large diameter hole part 713.

The flange part 72 of the intermediate member 7 of the cylinder head 12-1 is arranged to be in contact with the step part 105 of the plug hole 100-5. The intermediate member 7 is screwed with the front-side female screw part 101*a* of the small diameter part 101 in the plug hole 100-5 so that the flange part 72 of the intermediate member 7 of the cylinder head 12-1 is in contact and fitted with the step part 105 of the plug hole 100-5. This makes it possible to position the intermediate member 7 in the plug hole 100-5 and to fix the intermediate member 7 to the plug hole 100-5 in the axial direction Z.

Other components of the ignition device according to the fifth exemplary embodiment shown in FIG. 8 are the same as those of the ignition device according to the first exemplary embodiment shown in FIG. 1 to FIG. 3. Accordingly, the same components will be referred to with the same reference numbers and characters and the explanation of the same components is omitted here for brevity.

The ignition device 10 according to the sixth exemplary embodiment has the improved structure in which the front-side female screw part 101*a* is formed at the front end part of the plug hole 100-5. The cylinder head 12-1 is screwed with the front-side female screw part 101*a* of the plug hole 100-5. The cylinder head 12-1 further has the intermediate member 7. No female screw part is formed on the inner peripheral surface of the intermediate member 7. The head pressure fitting part 104 is formed on the inner peripheral surface of the intermediate member 7. This improved structure makes it possible to use the screw part of the cylinder head 12-1 to be screwed and fitted with the spark plug 1.

In addition to the features previously described, the ignition device according to the sixth exemplary embodiment shown in FIG. 8 has the same behavior and effects of the ignition device according to the first exemplary embodiment shown in FIG. 1 to FIG. 3.

Seventh Exemplary Embodiment

A description will be given of the spark plug and the ignition device according to a seventh exemplary embodiment with reference to FIG. 9.

Figure 9:
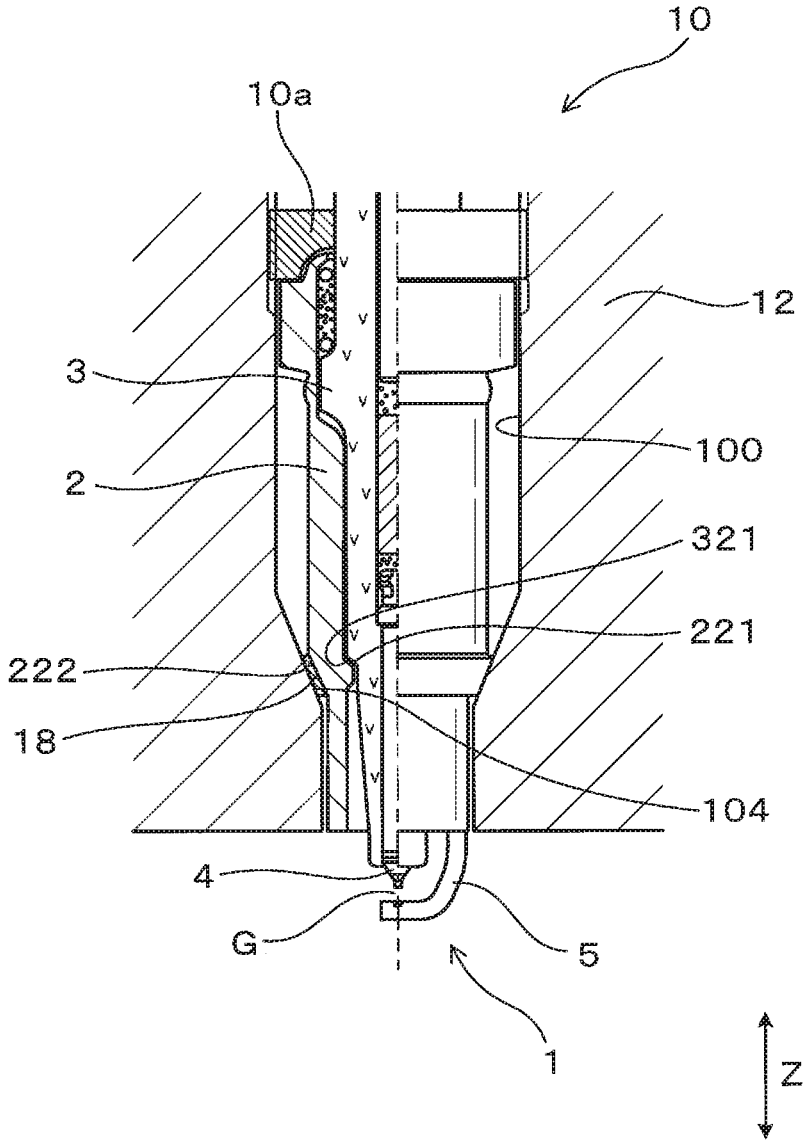
FIG. 9 is a front view showing a partial cross section of the ignition device using the spark plug according to a seventh exemplary embodiment of the present disclosure.

FIG. 9 is a front view showing a partial cross section of the ignition device using the spark plug according to the seventh exemplary embodiment of the present disclosure. In particular, as shown in FIG. 9, the ignition device according to the seventh exemplary embodiment further has a gasket 18 which is fitted into the pressure fitting part 222. Other components of the ignition device according to the seventh exemplary embodiment shown in FIG. 9 are the same as those of the ignition device according to the first exemplary embodiment shown in FIG. 1 to FIG. 3. Accordingly, the same components will be referred to with the same reference numbers and characters and the explanation of the same components is omitted here for brevity.

The gasket 18 is made of a plastic deformable member or an elastic deformable member having a ring shape or an annular shape. For example, the gasket 18 is made of metal. The gasket 18 has an inner peripheral surface and an outer peripheral surface, each diameter of which is reduced toward the front end side. In particular, the outer peripheral surface of the gasket 18 is in contact with the head pressure fitting part 104 of the plug hole 100 of the cylinder head 12. The inner peripheral surface of the gasket 18 is in contact with the pressure fitting part 222 of the spark plug housing 2. That is, the pressure fitting part 222 is forcedly in contact with the head pressure fitting part 104 through the gasket 18.

When the spark plug housing 2 is forcedly in contact with the head pressure fitting part 104 through the gasket 18, the pressure fitting part 222 acts as the contact part which is in contact with the gasket 18.

Other components of the ignition device according to the seventh exemplary embodiment shown in FIG. 9 are the same as those of the ignition device according to the first exemplary embodiment shown in FIG. 1 to FIG. 3.

In the structure of the ignition device according to the seventh exemplary embodiment shown in FIG. 9, the gasket 18 having thermal conductivity is arranged at the pressure fitting part 222 of the spark plug housing 2. Even if the pressure fitting part 222 and the head pressure fitting part 104 are not arranged in parallel with high accuracy due to occurrence of a dimensional tolerance in the ignition device, because the gasket 18 arranged between the pressure fitting part 222 and the head pressure fitting part 104 can be elastically or plastically deformed by the pressure force of a pressure member 10*a*, and the gasket 18 is in contact with both the pressure fitting part 222 and the head pressure fitting part 104. This structure allows thermal energy from the spark plug housing 2 to be conducted from the pressure fitting part 222 to the head pressure fitting part 104 through the gasket 18 with high efficiency. Accordingly, it is possible to maintain thermal energy discharging capability from the spark plug housing 2 to the cylinder head 12 even if the pressure fitting part 222 and the head pressure fitting part 104 are not arranged in parallel with high accuracy due to occurrence of a dimensional tolerance in the ignition device.

In addition to the features previously described, the ignition device according to the seventh exemplary embodiment shown in FIG. 9 has the same behavior and effects of the ignition device according to the first exemplary embodiment shown in FIG. 1 to FIG. 3.

Eighth Exemplary Embodiment

A description will be given of the spark plug and the ignition device according to an eighth exemplary embodiment with reference to FIG. 10 and FIG. 11.

Figure 10:
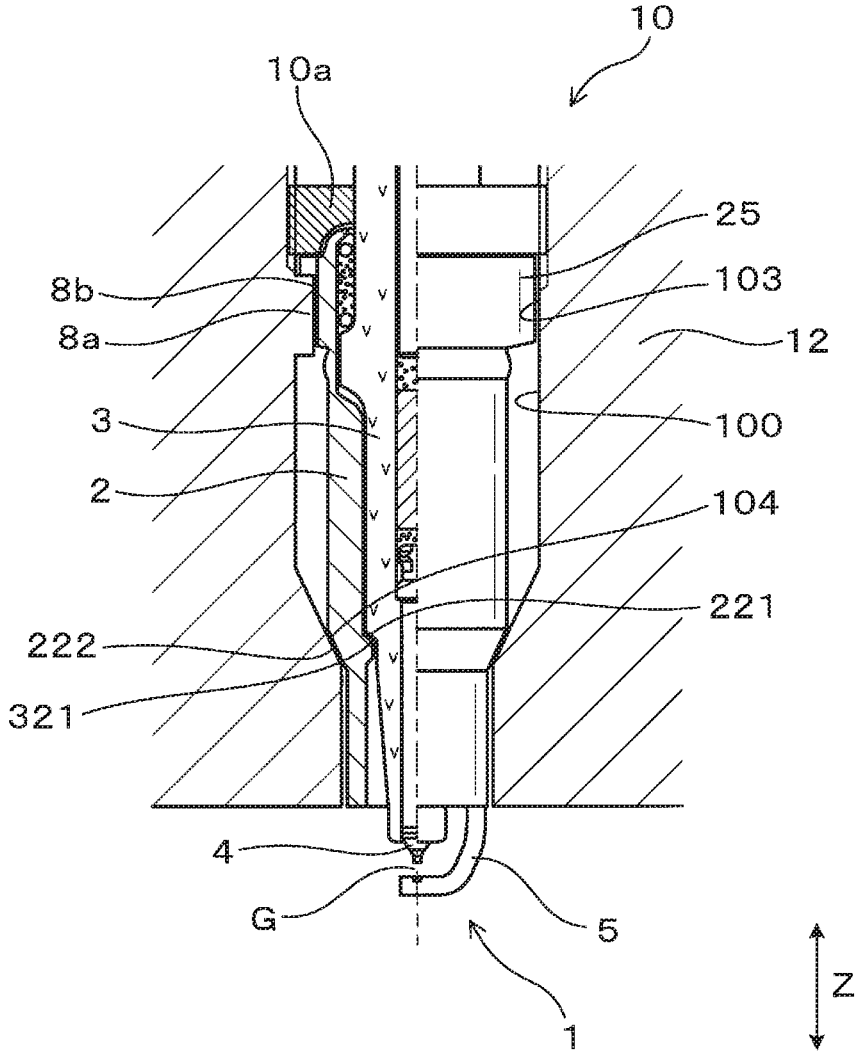
FIG. 10 is a front view showing a partial cross section of the ignition device using the spark plug according to an eighth exemplary embodiment of the present disclosure.

FIG. 10 is a front view showing a partial cross section of the ignition device using the spark plug according to the eighth exemplary embodiment of the present disclosure. FIG. 11 is a view showing a cross section of the ignition device with the spark plug in a direction, passing through a key protruding part, and a key groove, which is perpendicular to an axial direction of the spark plug according to the eighth exemplary embodiment of the present disclosure.

Figure 11:
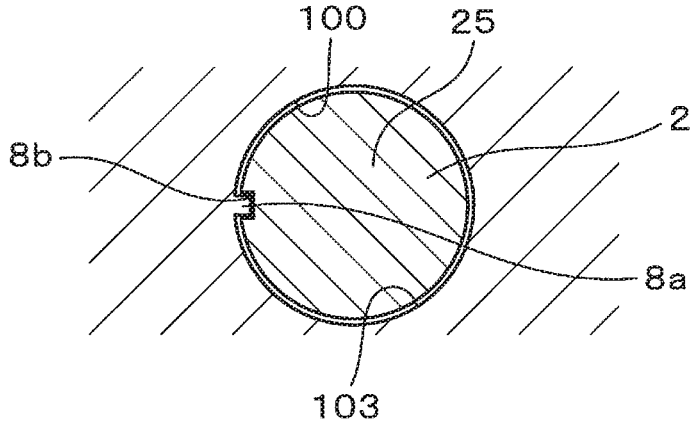
FIG. 11 is a view showing a cross section of the ignition device with the spark plug in a direction passing through a key protruding part and a key groove, which is perpendicular to an axial direction of the spark plug according to the eighth exemplary embodiment of the present disclosure.

As shown in FIG. 10 and FIG. 11, the ignition device according to the eighth exemplary embodiment further has a circumferential positioning mechanism between the spark plug 1 and the cylinder head 12. Other components of the ignition device according to the eighth exemplary embodiment shown in FIG. 10 and FIG. 11 are the same as those of the ignition device according to the first exemplary embodiment shown in FIG. 1 to FIG. 3. The interior components of the spark plug housing 2 are omitted from FIG. 11 for brevity.

The large diameter part 103 of the plug hole 100 has a key protruding part 8*a* which is formed at a part which projects toward the inner peripheral side. The key protruding part 8*a* has a projection shape formed straight in the axial direction Z.

A key groove 8*b* is formed on the outer peripheral surface of the spark plug 1, i.e. on the outer peripheral surface of the protruding part 25. The key groove 8*b* is fitted with the key protruding part 8*a*. The key groove 8*b* is formed along the key protruding part 8*a*. A size of the key groove 8*b* in the circumferential direction of the spark plug 1 is substantially equal to the size of the key protruding part 8*a*. Both end parts of the key groove 8*b* are open so as to insert the key protruding part 8*a* therein. Other components of the ignition device according to the eighth exemplary embodiment shown in FIG. 10 and FIG. 11 are the same as those of the ignition device according to the first exemplary embodiment shown in FIG. 1 to FIG. 3.

The structure of the ignition device according to the eighth exemplary embodiment makes it possible to easily position the spark plug 1 into the cylinder head 12 in a circumferential direction. In addition to the features previously described, the ignition device according to the eighth exemplary embodiment shown in FIG. 10 and FIG. 11 has the same behavior and effects of the ignition device according to the first exemplary embodiment shown in FIG. 1 to FIG. 3.

Figure 12:
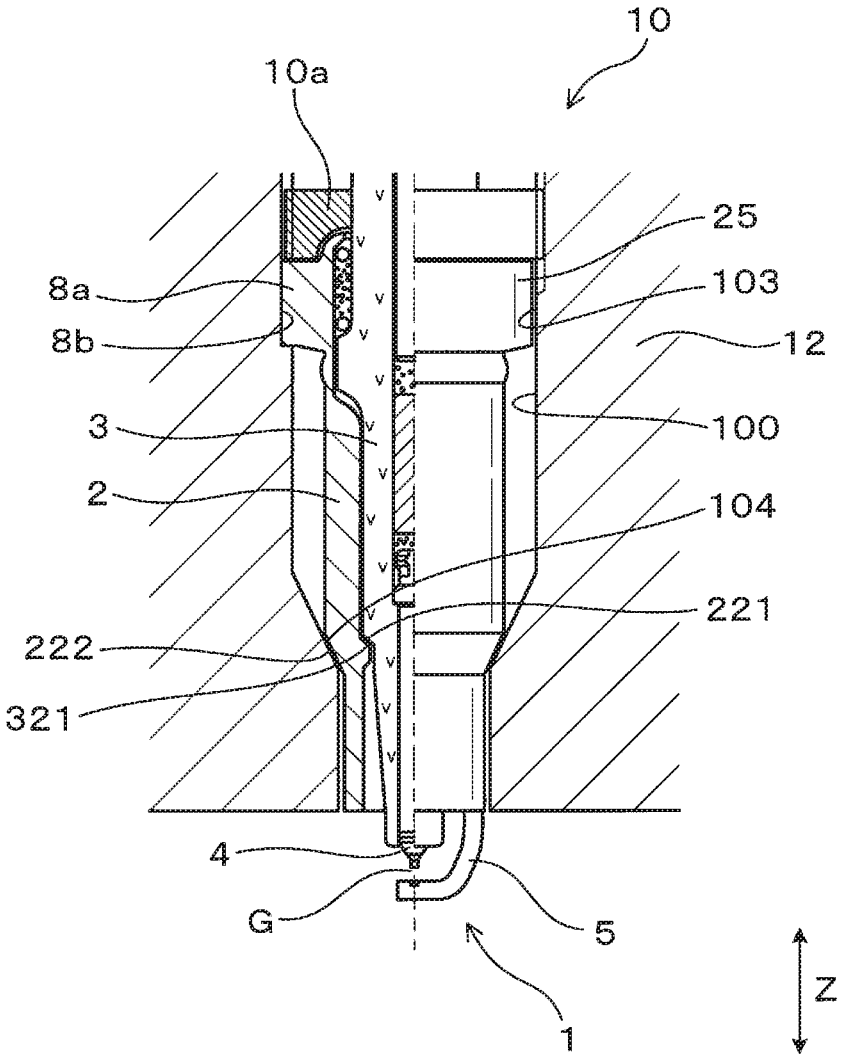
FIG. 12 is a front view showing a partial cross section of the ignition device using the spark plug according to a modification of the eighth exemplary embodiment of the present disclosure.
Figure 13:
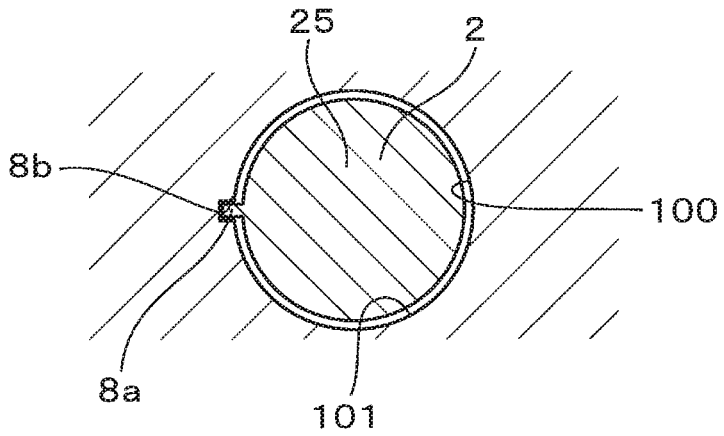
FIG. 13 is a view showing a cross section of the ignition device with the spark plug in a direction, passing through the key protruding part, and the key groove, which is perpendicular to an axial direction of the spark plug according to the modification of the eighth exemplary embodiment shown in FIG. 12.

FIG. 12 is a front view showing a partial cross section of the ignition device using the spark plug according to a modification of the eighth exemplary embodiment shown in FIG. 10 and FIG. 11. FIG. 13 is a view showing a cross section of the ignition device with the spark plug in a direction, passing through the key protruding part 8*a*, and the key groove 8*b*, which is perpendicular to an axial direction of the spark plug according to the modification of the eighth exemplary embodiment shown in FIG. 12.

As shown in FIG. 12 and FIG. 13, it is possible to form the key groove 8*b* in the plug hole 100 and the key protruding part 8*a* is formed in the spark plug 1. In the structure of the modification of the eight exemplary embodiment, as shown in FIG. 12 and FIG. 13, a distal end part of the key groove 8*b* is formed to the edge part at the distal end side of the plug hole 100.

Ninth Exemplary Embodiment

A description will be given of the spark plug and the ignition device according to a ninth exemplary embodiment with reference to FIG. 14.

Figure 14:
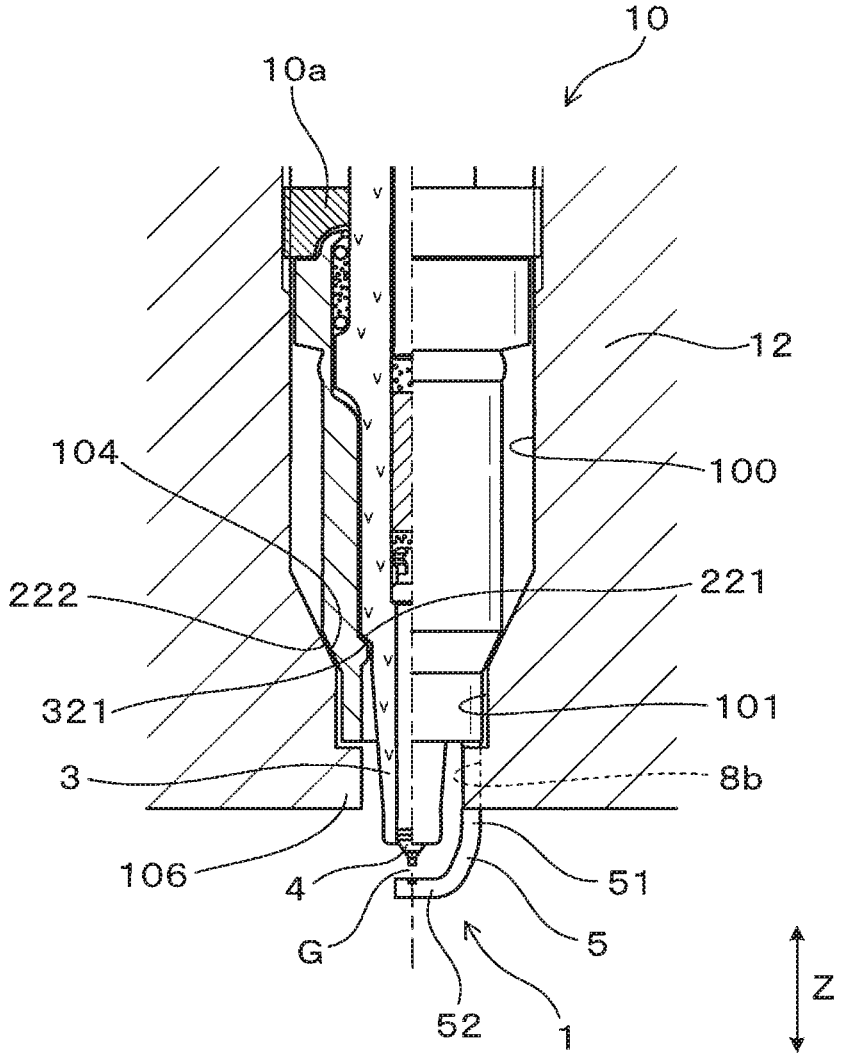
FIG. 14 is a front view showing a partial cross section of the ignition device using the spark plug according to a ninth exemplary embodiment of the present disclosure.
Figure 15:
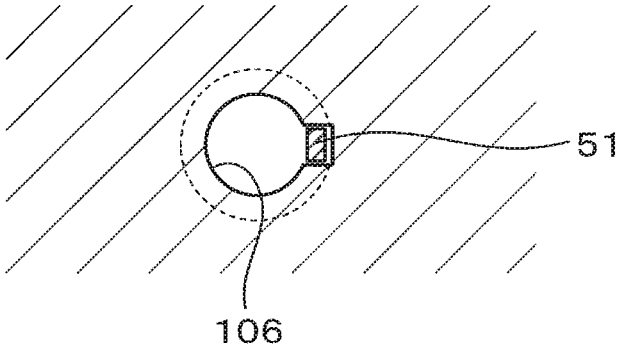
FIG. 15 is a view showing a cross section of a cylinder head and a ground electrode of the ignition device with the spark plug in a direction passing through the key groove according to the ninth exemplary embodiment shown in FIG. 14.

FIG. 14 is a front view showing a partial cross section of the ignition device using the spark plug according to the ninth exemplary embodiment of the present disclosure. FIG. 15 is a view showing a cross section of the cylinder head and the ground electrode of the ignition device with the spark plug in a direction passing through the key groove according to the ninth exemplary embodiment shown in FIG. 14.

As shown in FIG. 14 and FIG. 15, the ignition device according to the ninth exemplary embodiment further has a circumferential positioning mechanism between the spark plug 1 and the cylinder head 12. Other components of the ignition device according to the eighth exemplary embodiment shown in FIG. 14 and FIG. 15 are the same as those of the ignition device according to the first exemplary embodiment shown in FIG. 1 to FIG. 3.

In the structure of the ignition device according to the ninth exemplary embodiment, a reduced diameter part 106 is formed at the front end part of the small diameter part 101 in the plug hole 100. The reduced diameter part 106 has a radius which is smaller than the radius at the distal end side of the small diameter part 101. The key groove 8*b* is formed at a part in a circumferential direction of the reduced diameter part 106. As shown in FIG. 14, the key groove 8*b* is concaved toward the outer peripheral side of the small diameter part 101. The key groove 8*b* is formed to have a longitudinal shape in the axial direction Z. Both end parts in the axial direction of the key groove 8*b* are open.

The rod-shaped part 51 of the ground electrode 5 is inserted and fitted into the inside of the key groove 8*b*. The key groove 8*b* is formed along the shape of the ground electrode 5. As shown in FIG. 15, the key groove 8*b* has a circumferential size which is substantially equal to the size of the rod-shaped part 51 of the ground electrode 5.

The front end part of the spark plug housing 2 faces the distal end side surface of the reduced diameter part 106 in the axial direction Z through a gap.

The insulator 3 and the center electrode 4 project to the front end side of the reduced diameter part 106 in the axial direction Z when viewed from the spark plug housing 2.

Other components of the ignition device according to the eighth exemplary embodiment shown in FIG. 14 and FIG. 15 are the same as those of the ignition device according to the first exemplary embodiment shown in FIG. 1 to FIG. 3.

The structure of the ignition device according to the ninth exemplary embodiment makes it possible to easily position the spark plug 1 into the cylinder head 12 in the circumferential direction. In addition to the features previously described, the ignition device according to the ninth exemplary embodiment shown in FIG. 14 and FIG. 15 has the same behavior and effects of the ignition device according to the first exemplary embodiment shown in FIG. 1 to FIG. 3.

Tenth Exemplary Embodiment

A description will be given of the spark plug and the ignition device according to a tenth exemplary embodiment with reference to FIG. 16.

Figure 16:
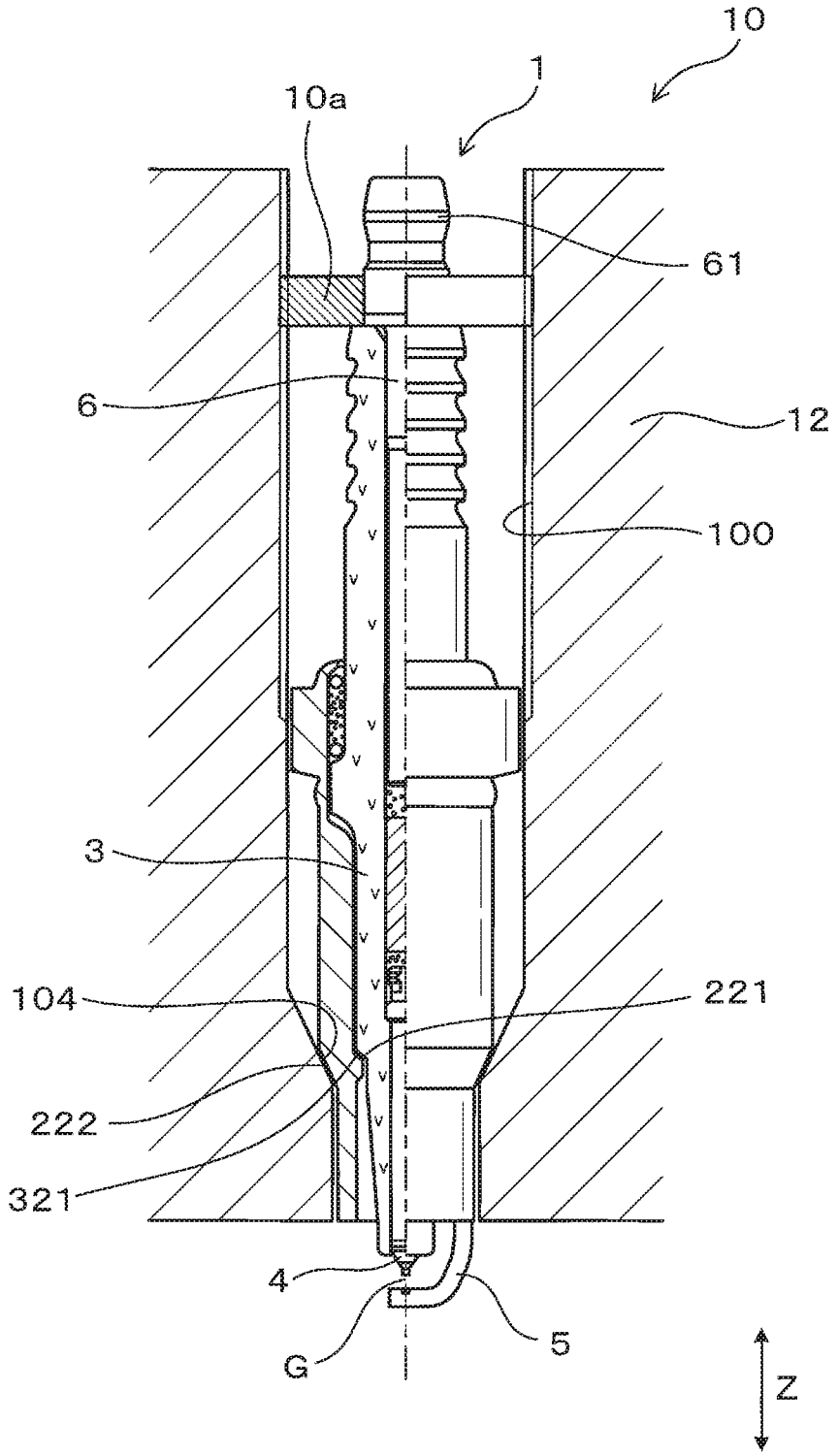
FIG. 16 is a front view showing a partial cross section of the ignition device using the spark plug according to a tenth exemplary embodiment of the disclosure.

FIG. 16 is a front view showing a partial cross section of the ignition device using the spark plug according to the tenth exemplary embodiment of the disclosure. As shown in FIG. 16, the spark plug according to the tenth exemplary embodiment has the structure in which the pressure member 10*a* presses the insulator 3 of the spark plug 1 toward the front end side of the spark plug 1, i.e. in the axial direction Z of the spark plug 1. The overall front end surface of the pressure member 10*a* has a flat shape which is perpendicular to the axial direction Z of the spark plug 1. The inner-peripheral side end part at the front end part of the pressure member 10*a* presses the distal end surface of the insulator 3 toward the front end side of the spark plug 1.

The terminal metal fitting 6 has the projection part 61 which projects toward the distal end side of the insulator 3. The projection part 61 is inserted into the inside of the pressure member 10*a*. In the tenth exemplary embodiment, the pressure member 10*a* is made of an electrically insulating material.

Other components of the ignition device according to the tenth exemplary embodiment shown in FIG. 16 are the same as those of the ignition device according to the first exemplary embodiment shown in FIG. 1 to FIG. 3.

In the structure of the ignition device according to the tenth exemplary embodiment, the pressure member 10*a* presses the insulator 3 of the spark plug 1. This makes it possible to forcedly press the insulator support surface 321 of the insulator 3 to the housing support surface 221 of the spark plug housing 2 by the pressing force of the pressure member 10*a*. This structure makes it possible to maintain the pressing force of the housing support surface 221 of the spark plug housing 2 to the insulator support surface 321. This makes it possible to improve the airtightness between the insulator support surface 321 and the housing support surface 221.

In addition to the features previously described, the ignition device according to the tenth exemplary embodiment shown in FIG. 16 has the same behavior and effects of the ignition device according to the first exemplary embodiment shown in FIG. 1 to FIG. 3.

Tenth Exemplary Embodiment

A description will be given of the spark plug and the ignition device according to an eleventh exemplary embodiment with reference to FIG. 17.

Figure 17:
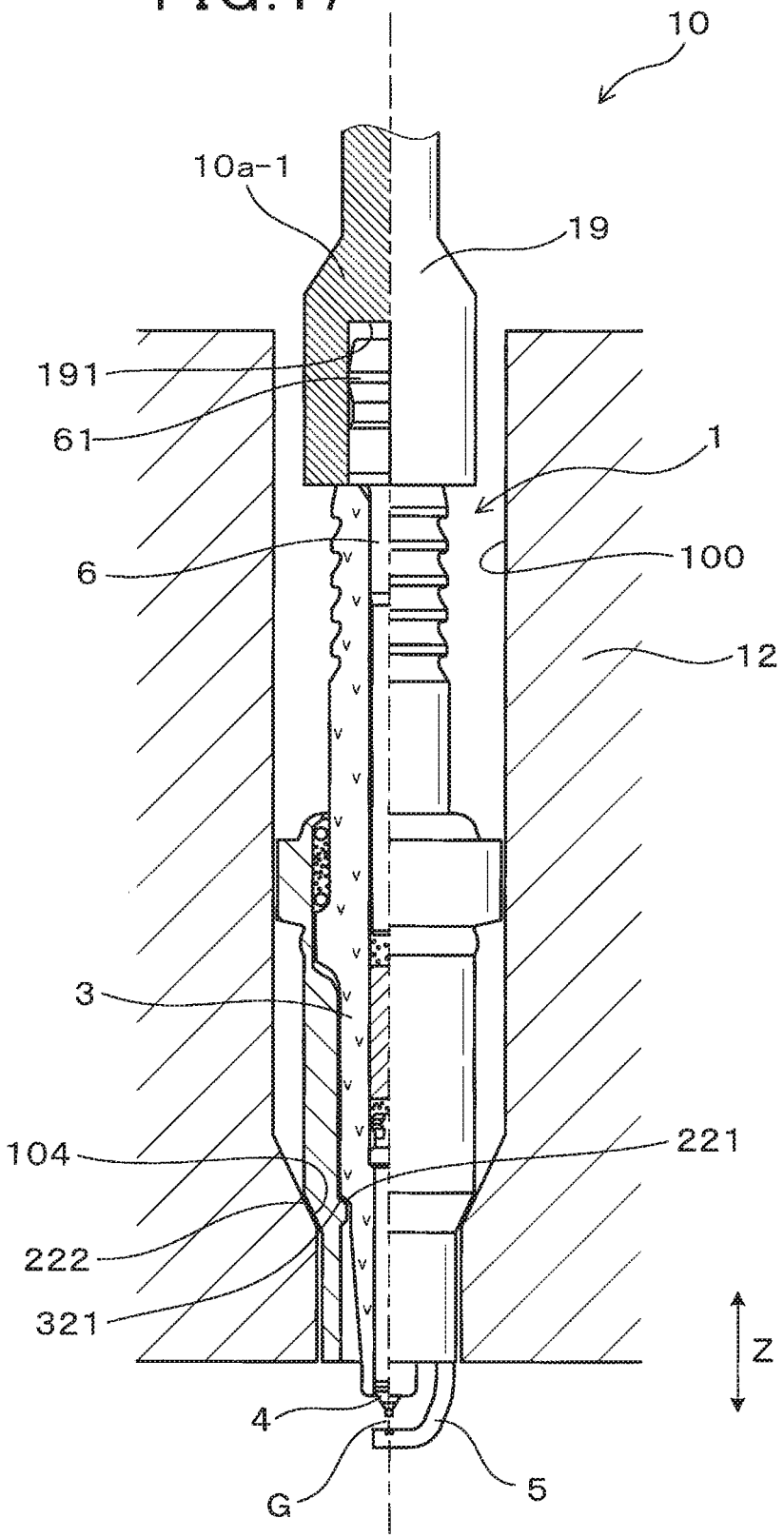
FIG. 17 is a front view showing a partial cross section of the ignition device using the spark plug according to an eleventh exemplary embodiment of the disclosure.

FIG. 17 is a front view showing a partial cross section of the ignition device using the spark plug according to the eleventh exemplary embodiment of the disclosure. As shown in FIG. 17, the ignition device according to the eleventh exemplary embodiment has a pressure member 10*a*-1 which is different in structure from the pressure member 10*a* in the ignition device according to the tenth exemplary embodiment shown in FIG. 16.

The ignition device 10 according to the eleventh exemplary embodiment has an ignition coil (omitted from FIG. 17) which generates a high voltage. The ignition coil has a primary coil (not shown) and a secondary coil (not shown) magnetically connected together, for example. When electric power is supplied to the primary coil, electromagnetic induction is generated in the ignition coil, and a high voltage is generated in the secondary coil.

The structure of the ignition device 10 according to the eleventh exemplary embodiment further has a conductive member 19 through which an output of the ignition coil is transmitted to the terminal metal fitting 6.

The output terminal of the ignition coil (not shown) in the ignition device 10 is electrically connected to the terminal metal fitting 6 of the spark plug 1 through the conductive member 19.

An inserting hole 191 is formed in the end part of the conductive member 19 at the spark plug 1 side. A terminal projecting part 61 of the spark plug 1 is inserted to the inside of the spark plug 1 through the inserting hole 191. The inserting hole 191 is formed so that the front end surface of the conductive member 19 is concaved toward the distal end side thereof. The front end surface of the inserting hole 191 presses the distal end surface of the insulator 3 toward the front side of the spark plug 1 in the axial direction Z. That is, the conductive member 19 forms the pressure member 10*a*.

The projection part 61 is inserted and fitted into the inserting hole 191. The inner peripheral surface of the inserting hole 191 is in contact with the outer peripheral surface of the projection part 61. This allows the conductive member 19 to be electrical contact with the terminal metal fitting 6.

Other components of the ignition device according to the eleventh exemplary embodiment shown in FIG. 17 are the same as those of the ignition device according to the first exemplary embodiment shown in FIG. 1 to FIG. 3.

In the structure of the ignition device according to the eleventh exemplary embodiment shown in FIG. 17, it is possible to use the conductive member 19 as the pressure member 10*a*. This makes it possible to reduce the total number of components of the ignition device. In addition to the features previously described, the ignition device according to the eleventh exemplary embodiment shown in FIG. 17 has the same behavior and effects of the ignition device according to the first exemplary embodiment shown in FIG. 1 to FIG. 3.

Twelfth Exemplary Embodiment

A description will be given of the spark plug and the ignition device according to a twelfth exemplary embodiment with reference to FIG. 18.

Figure 18:
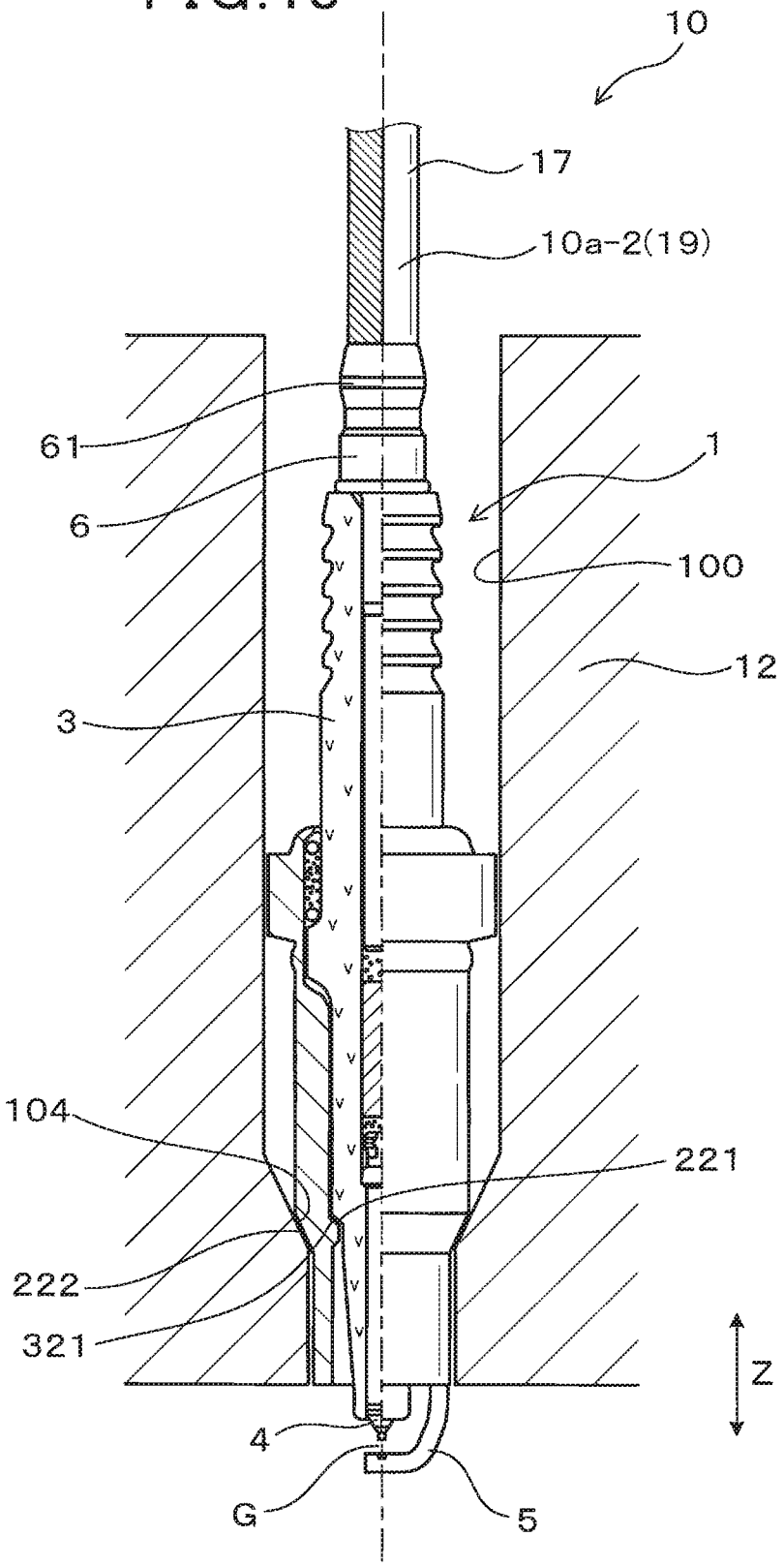
FIG. 18 is a front view showing a partial cross section of the ignition device using the spark plug according to a twelfth exemplary embodiment of the disclosure.

FIG. 18 is a front view showing a partial cross section of the ignition device using the spark plug according to the twelfth exemplary embodiment of the disclosure. As shown in FIG. 18, the conductive member 19 is used as a press member 10*a*-2 which pushes the terminal metal fitting 6 of the spark plug 1 toward the front end side of the spark plug 1 in the axial direction Z. At least the front end part of the conductive member 19 has a rod shape so as to press the distal end surface of the projection part 61 of the terminal metal fitting 6 toward the front end side of the spark plug 1 in the axial direction Z.

Other components of the ignition device according to the twelfth exemplary embodiment shown in FIG. 18 are the same as those of the ignition device according to the first exemplary embodiment shown in FIG. 1 to FIG. 3. Accordingly, the same components will be referred to with the same reference numbers and characters and the explanation of the same components is omitted here for brevity.

In the structure of the ignition device according to the twelfth exemplary embodiment, the press member 10*a*-2 presses the insulator 3 toward the front of the spark plug 1 through the terminal metal fitting 6 of the spark plug 1. Accordingly, the insulator 3 is pressed toward the front end side of the spark plug 1 by the pressed force of the press member 10*a*-2, the insulator support surface 321 of the insulator 3 is forcedly pressed to the housing support surface 221 of the spark plug housing 2 in the axial direction Z. This structure makes it possible to maintain the effective pressing force of the insulator support surface 321 to the housing support surface 221 in an axial direction Z. This makes it possible to increase the airtightness between the insulator support surface 321 and the housing support surface 221 in the ignition device.

In addition to the features previously described, the ignition device according to the twelfth exemplary embodiment shown in FIG. 18 has the same behavior and effects of the ignition device according to the first exemplary embodiment shown in FIG. 1 to FIG. 3.

For example, in a structure using a male screw part with which the spark plug 1 is screwed to the plug hole 100, it is acceptable to screw the male screw part into a specific member and to form the pressure fitting part 222 in the specific member.

Incidentally, there has been used a common technique in which a spark plug is fixed to a cylinder head of an internal combustion engine by using a screw part formed on the outer peripheral surface of the spark plug housing. The screw part is screwed with a female screw part formed in a plug hole formed in the cylinder head.

However, such a common technique causes difficulty of adjusting a fixing position of the spark plug to the cylinder head and of adjusting a correct position of the ground electrode of the spark plug in the circumferential direction with high accuracy because the position of the spark plug easily varies due to a dimensional tolerance of a screw part of the spark plug housing and a degree of fastening the spark plug to the cylinder head of the internal combustion engine during an assembling step.

The ignition capability of the spark plug varies due to a position of the ground electrode of the spark plug in the circumferential direction. For example, when a part of the ground electrode is arranged at an upstream side of the discharge gap in a fuel gas mixture in the combustion chamber of the internal combustion engine, the presence of the ground electrode prevents the fuel gas mixture from flowing in the discharge gap between the center electrode and the ground electrode. As a result, this reduces the ignition capability of the spark plug. There is a strong demand of providing a spark plug capable of easily adjusting a position of the spark plug to the cylinder head of the internal combustion engine with high accuracy.

A related technique provides an ignition device and a spark plug without using a male screw part and a cylinder head having no female screw part so as to mount and fix the spark plug to the cylinder head without using any screw part. This ignition device has the spark plug housing with a plug seat to be in contact with the cylinder head. The spark plug is pressed by a plug hole pipe formed in the plug hole in the cylinder head side so as to fix the spark plug to the cylinder head. This structure of the ignition device makes it possible to arrange the ground electrode at a necessary position in a circumferential direction of the ignition device.

However, in the structure of the ignition device and the spark plug according to the related art, although the spark plug is pressed to the cylinder head through the plug seat of the spark plug housing, another area excepting the plug seat is not adequately in contact with the cylinder head. That is, in the structure of the ignition device according to the related art, a gap is formed between the spark plug housing and the plug hole of the cylinder head so as to adjust the position of the ground electrode in the circumferential direction by rotating the spark plug to the cylinder head. Accordingly, the ignition device according to the related are has low thermal conductivity from the spark plug to the cylinder head. In the structure of the ignition device according to the related art, it is difficult to discharge thermal energy generated at the front end part of the spark plug which is exposed into the inside of the combustion chamber of the internal combustion engine. The ignition device according to the related art has a possible case of occurring a pre-ignition phenomenon, and of causing deterioration of the center electrode and the ground electrode, and of melting the center electrode and the ground electrode.

On the other hand, as previously described in detail, the present disclosure provides the spark plug and the ignition device having the improved structure and superior thermal conductivity. It is accordingly possible to solve and avoid such related-art problem. The present disclosure provides the spark plug with no screw part and the ignition device using the spark plug having superior thermal discharging capability of discharging thermal energy from the spark plug to the cylinder head of the internal combustion engine.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug of an internal combustion engine comprising:

a spark plug housing having a cylindrical shape, an outer peripheral surface of which has no male screw part formed thereon;

an insulator having a cylindrical shape inserted and fitted in the spark plug housing;

a center electrode arranged in and supported by an inside of the insulator; and a ground electrode connected to the spark plug housing, a discharge gap being formed between the ground electrode and the center electrode, wherein:

a housing support surface is formed on an inner peripheral surface of the spark plug housing, an outer peripheral surface of the insulator comprises an insulator support surface which is supported by the housing support surface in an axial direction of the spark plug; and the spark plug housing comprises:

a large diameter part;

a slope part having a pressure fitting part, the pressure fitting part having a taper shape in which a diameter of the pressure fitting part is reduced radially inwardly toward an inner peripheral side of the spark plug housing and from the large diameter part toward a front end part in the axial direction of the spark plug housing; and a small diameter part extending from the slope part toward the front end part in the axial direction of the spark plug housing, wherein:

the pressure fitting part is pressed to a cylinder head of the internal combustion engine, a part of the pressure fitting part and a part of at least one of the housing support surface and the insulator support surface are arranged to be overlapped with each other in a radial direction of the spark plug, wherein;

the pressure fitting part of the spark plug housing and the insulator support surface of the insulator are configured to be pressed to the front end part in the axial direction of the spark plug housing by pressure force;

a length of the pressure fitting part is longer in the axial direction of the spark plug than a length of the insulator support surface of the insulator; and the large diameter part and the small diameter part are arranged to be spaced apart from the cylinder head.

2. The spark plug according to claim 1, further comprising a gasket having thermal conductivity arranged to the pressure fitting part.

3. An ignition device of an internal combustion engine comprising:

a cylinder head of the internal combustion engine, the cylinder head with a plug hole formed in an inside of the cylinder head;

a spark plug assembled with the plug hole of the cylinder head; and a press member pushing the spark plug toward the cylinder head, wherein the spark plug comprises:

a spark plug housing having a cylindrical shape, an outer peripheral surface of which has no male screw part formed thereon;

an insulator having a cylindrical shape inserted and fitted in the spark plug housing;

a center electrode arranged in and supported by an inside of the insulator; and a ground electrode connected to the spark plug housing, a discharge gap being formed between the ground electrode and the center electrode, wherein:

a housing support surface is formed on an inner peripheral surface of the spark plug housing, an outer peripheral surface of the insulator comprises an insulator support surface which is supported by the housing support surface in an axial direction of the spark plug; and the spark plug housing comprises:

a large diameter part;

a slope part having a pressure fitting part, the pressure fitting part having a taper shape in which a diameter of the pressure fitting part is reduced radially inwardly toward an inner peripheral side of the spark plug housing and from the large diameter part toward a front end part in the axial direction of the spark plug housing; and a small diameter part extending from the slope part toward the front end part in the axial direction of the spark plug housing, wherein:

the pressure fitting part is pressed to a head pressure fitting part of the cylinder head of the internal combustion engine, a part of the pressure fitting part and a part of at least one of the housing support surface and the insulator support surface are arranged to be overlapped with each other in a radial direction of the spark plug;

the press member pushes the spark plug to the cylinder head, the spark plug is supported between the press member and the head pressure fitting part, the pressure fitting part is configured to be pressed to the cylinder head of the internal combustion engine by pressure force in the axial direction of the spark plug housing of the press member;

a length of the pressure fitting part is longer in the axial direction of the spark plug than a length of the insulator support surface of the insulator; and the large diameter part and the small diameter part are arranged to be spaced apart from the cylinder head.

4. The ignition device according to claim 3, wherein each of the pressure fitting part and the head pressure fitting part has a taper shape in which a diameter thereof is reduced radially inwardly toward an inner peripheral side of the spark plug housing and is reduced radially inwardly toward the front end part in the axial direction of the spark plug housing, and the pressure fitting part of the spark plug housing and the head pressure fitting part are arranged facing each other.

5. The ignition device according to claim 3, wherein a front-side female screw part is formed at a front end part of the plug hole, and a female screw is formed in the front-side female screw part, and the cylinder head comprises an intermediate member having thermal conductivity which is screwed with the front-side female screw part of the plug hole, and the head pressure fitting part is formed on an inner peripheral surface of the intermediate member.

6. The ignition device according to claim 4, wherein a front-side female screw part is formed at a front end part of the plug hole, and a female screw is formed in the front-side female screw part, and the cylinder head comprises an intermediate member having thermal conductivity which is screwed with the front-side female screw part of the plug hole, and the head pressure fitting part is formed on an inner peripheral surface of the intermediate member.

7. The ignition device according to claim 3, wherein the spark plug further comprises a terminal metal fitting, supported by the inside of the insulator, a distal end part of the terminal metal fitting projects toward the distal end side of the insulator viewed in the axial direction, and the press member presses at least one of the insulator and the terminal metal fitting in the spark plug.

8. The ignition device according to claim 4, wherein the spark plug further comprises a terminal metal fitting, supported by the inside of the insulator, a distal end part of the terminal metal fitting projects toward the distal end side of the insulator viewed in the axial direction, and the press member presses at least one of the insulator and the terminal metal fitting in the spark plug.

9. The ignition device according to claim 3, wherein the spark plug housing comprises a caulked part pressing the insulator toward a front end side in the axial direction of the spark plug, and the press member presses the caulked part in the spark plug.

10. The ignition device according to claim 4, wherein the spark plug housing comprises a caulked part pressing the insulator toward the front end side in the axial direction of the spark plug, and the press member presses the caulked part in the spark plug.

* * * * *